US009689053B2

(12) United States Patent
Yamasaski et al.

(10) Patent No.: US 9,689,053 B2
(45) Date of Patent: Jun. 27, 2017

(54) STEEL ROD AND HIGH STRENGTH STEEL WIRE HAVING SUPERIOR DUCTILITY AND METHODS OF PRODUCTION OF SAME

(71) Applicant: Nippon Steel & Sumitomo Metal Corporation, Tokyo (JP)

(72) Inventors: Shingo Yamasaski, Tokyo (JP); Seiki Nishida, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/939,848

(22) Filed: Nov. 12, 2015

(65) Prior Publication Data

US 2016/0145713 A1 May 26, 2016

Related U.S. Application Data

(62) Division of application No. 12/452,816, filed as application No. PCT/JP2009/054967 on Mar. 9, 2009, now Pat. No. 9,212,410.

(30) Foreign Application Priority Data

Mar. 25, 2008 (JP) ..... 2008-078146
Apr. 8, 2008 (JP) ..... 2008-100385

(51) Int. Cl.
*C21D 9/00* (2006.01)
*C21D 9/52* (2006.01)
(Continued)

(52) U.S. Cl.
CPC ..... *C21D 9/525* (2013.01); *B21C 1/003* (2013.01); *C21D 6/004* (2013.01); *C21D 6/005* (2013.01);
(Continued)

(58) Field of Classification Search
CPC ..... C21D 2211/009; C21D 6/00; C22C 38/00; B21C 1/003
(Continued)

(56) References Cited

U.S. PATENT DOCUMENTS 6,645,319 B2 11/2003 Nagao et al.
6,783,609 B2 8/2004 Hata et al.
(Continued)

FOREIGN PATENT DOCUMENTS

CN 101208445 6/2008
CN 101208446 6/2008
(Continued)

OTHER PUBLICATIONS

European Search Report dated Jul. 9, 2015 in corresponding European Application No. 09725961.8.
(Continued)

*Primary Examiner* — Jie Yang
(74) *Attorney, Agent, or Firm* — Birch, Stewart, Kolasch & Birch, LLP

(57) ABSTRACT

The present invention inexpensively provides with high productivity and good yield a steel rod superior in drawability and a steel wire superior in twistability using the same as a material, that is, draws a high strength steel rod superior in ductility where the chemical components contain C: 0.80 to 1.20%, Si: 0.1 to 1.5%, Mn: 0.1 to 1.0%, Al: 0.01% or less, Ti: 0.01% or less, one or both of W: 0.005 to 0.2% and Mo: 0.003 to 0.2%, N: 10 to 30 ppm, B: 4 to 30 ppm (of which, solute B is 3 ppm or more), and O: 10 to 40 ppm, which has a balance of Fe and unavoidable impurities, has an area percentage of pearlite structures of 97% or more, has a balance of non-pearlite structures, and has a total of the area percentage of the non-pearlite structures and the area percentage of the coarse pearlite structures of 15% or less, to
(Continued)

obtain high strength steel wire superior in ductility having a tensile strength of 3600 MPa or more and a number density of voids of lengths of 5 μm or more at the center of 100/mm$^2$ or less.

4 Claims, 7 Drawing Sheets

(51) Int. Cl.

| | |
|---|---|
| ***C21D 8/06*** | (2006.01) |
| ***C22C 38/00*** | (2006.01) |
| ***C22C 38/02*** | (2006.01) |
| ***C22C 38/04*** | (2006.01) |
| ***C22C 38/54*** | (2006.01) |
| ***C22C 38/06*** | (2006.01) |
| ***C22C 38/12*** | (2006.01) |
| ***B21C 1/00*** | (2006.01) |
| ***D07B 1/06*** | (2006.01) |
| ***C22C 38/10*** | (2006.01) |
| ***C22C 38/14*** | (2006.01) |
| ***C22C 38/16*** | (2006.01) |
| ***C22C 38/20*** | (2006.01) |
| ***C22C 38/22*** | (2006.01) |
| ***C22C 38/30*** | (2006.01) |
| ***C22C 38/32*** | (2006.01) |
| ***C21D 6/00*** | (2006.01) |
| ***C22C 38/08*** | (2006.01) |
| ***C22C 38/26*** | (2006.01) |
| ***C22C 38/28*** | (2006.01) |

(52) U.S. Cl.

CPC ..... *C21D 6/007* (2013.01); *C21D 6/008* (2013.01); *C21D 8/065* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/20* (2013.01); *C22C 38/22* (2013.01); *C22C 38/26* (2013.01); *C22C 38/28* (2013.01); *C22C 38/30* (2013.01); *C22C 38/32* (2013.01); *C22C 38/54* (2013.01); *D07B 1/066* (2013.01); *C21D 2211/009* (2013.01); *D07B 2205/3035* (2013.01); *D07B 2205/3057* (2013.01)

(58) Field of Classification Search

USPC ..... 148/599

See application file for complete search history.

(56) References Cited

U.S. PATENT DOCUMENTS

| | | | | |
|---|---|---|---|---|
| 7,258,756 | B2 | 8/2007 | Nagao et al. | |
| 8,142,577 | B2 | 3/2012 | Yamasaki et al. | |
| 9,212,410 | B2 * | 12/2015 | Yamasaki ..... | C21D 8/065 |
| 2006/0048864 | A1 | 3/2006 | Nagao et al. | |
| 2009/0151824 | A1 | 6/2009 | Yamasaki et al. | |
| 2009/0229711 | A1 | 9/2009 | Yamasaki et al. | |

FOREIGN PATENT DOCUMENTS

| | | |
|---|---|---|
| JP | 6-330239 | 11/1994 |
| JP | 08-003639 | 1/1996 |
| JP | 2001-131697 | 5/2001 |
| JP | 2001-234286 | 8/2001 |
| JP | 2004-360005 | 12/2004 |
| JP | 2007-131944 | 5/2007 |
| JP | 2007-131945 | 5/2007 |
| JP | 2008-261028 | 10/2008 |

OTHER PUBLICATIONS

Chinese Patent Publication No. 101765672 issued May 23, 2012 (first page).

International Search Report dated Jun. 9, 2009 issued in corresponding PCT Application No. PCT/JP2009/054967, first page, English-language abstract included.

* cited by examiner (a)

(NON-PEARLITE INDICATED BY ARROW)

(b)

(COARSE PEARLITE INDICATE BY ARROW)

(VOID INDICATED BY ARROW)

STEEL ROD AND HIGH STRENGTH STEEL WIRE HAVING SUPERIOR DUCTILITY AND METHODS OF PRODUCTION OF SAME

This application is a divisional application of U.S. application Ser. No. 12/452,816, filed on Jan. 22, 2010, which is a national stage application of International Application No. PCT/JP2009/054967, filed Mar. 9, 2009, which claims priority to Japanese Application Nos. 2008-078146, filed Mar. 25, 2008, and 2008-100385, filed Apr. 8, 2008. Each of U.S. application Ser. No. 12/452,816, International Application No. PCT/JP2009/054967, and Japanese Application Ser. Nos. 2008-078146 and 2008-100385 are incorporated herein in by reference in their entities.

TECHNICAL FIELD

The present invention relates to a steel rod superior in ductility, a high strength steel wire superior in ductility and twistability produced using the steel rod, and methods of production of the same. More specifically, it relates to a rolled steel rod superior in ductility for obtaining steel wire suitable for steel cord used as reinforcement material in for example automobile radial tires, belts for industrial use, and the like, further a sawing wire, and other applications, a high strength steel wire mentioned above obtained from the rolled rod, and methods of production of the same.

BACKGROUND ART

Steel wire for steel cord used as reinforcement material for automobile radial tires, various belts, and hoses or steel wire for sawing wire is generally produced by hot rolling a steel billet, then controllably cooling it to obtain a steel rod (rolled rod) of a diameter of 4 to 6 mm, and drawing this rolled rod to a diameter 0.15 to 0.40 mm ultrafine wire. Further, these ultrafine steel wires are twisted together to form steel wire strands to thereby produce steel cord.

The drawing process comprises drawing the 4 to 6 mm rolled steel rod by primary drawing to a diameter of 3 to 4 mm, then intermediate patenting it and further drawing it by secondary drawing to a 1 to 2 mm diameter. After this, final patenting, brass plating and final wet drawing are performed. Final diameter of steel wire is 0.15 to 0.40 mm.

In recent years, to reduce production costs, intermediate patenting has been omitted and the rolled rod after controlled cooling has been drawn directly up to the final patenting wire diameter of 1 to 2 mm in increasing cases. Therefore, direct drawability from the rolled rod, is being demanded. The ductility and workability of the rolled rod are then becoming important.

The index showing the ductility of the steel rod, that is the area reduction, depends on the austenite grain size. It rises as the austenite grain size is refined. Attempts have been therefore made using Nb, Ti, B, and other carbides and nitrides as pinning particles so as to refine the austenite grain size.

For example, Japanese Patent Publication (A) No. 8-3639 discloses an art of including one or more of Nb: 0.01 to 0.1%, Zr: 0.05 to 0.1%, and Mo: 0.02 to 0.5% as additive elements so as to further increase the toughness and ductility of ultrafine steel wire.

Japanese Patent Publication (A) No. 2001-131697 also proposes refining the austenite grain size using NbC.

However, these additive elements are expensive, so cause cost increase. Further, Nb forms coarse carbides and nitrides and Ti forms coarse oxides, so there have been cases of breakage if drawing up to a thin wire size of a diameter of 0.40 mm or less. Further, according to verification by the inventors, it has been confirmed that with BN pinning, refining of austenite grain size to a degree having an effect on the area reduction rate is difficult.

On the other hand, as shown in Japanese Patent Publication (A) No. 8-3639, there is proposed an art of reducing the patenting temperature to control the structure of the steel rod to bainite and thereby increase the drawability of a high carbon steel rod. However, in order to make a rolled rod a bainite structure in-line, it is necessary to immerse it in molten salt. This treatment causes high costs and simultaneously is liable to reduce the mechanical descaling performance.

DISCLOSURE OF THE INVENTION

The present invention was made in consideration of the above situation and has as its object to provide a steel rod superior in ductility for producing steel wire suitable for steel cord, sawing wire, and other applications and steel wire produced from the steel rod and to provide a method of producing the steel rod with high productivity and good yield in low cost.

The inventors took note of the coarse voids which occur in the drawing process as the factor causing deterioration of the ductility of the steel rod and wire. Further, the inventors found that if the formation of such voids can be suppressed, the direct drawability of a steel rod rises and steel wire with increased twistability can be obtained.

Based on such findings, the present invention solves the above problems by the steel rod shown in (1) and (2), the steel wire shown in (3), the method of producing the steel rod shown in (4), and the method of producing the steel wire shown in (5).

(1) Steel rod for high strength steel wire superior in ductility characterized by the chemical components containing, by mass % or mass ppm, C: 0.80 to 1.20%, Si: 0.1 to 1.5%, Mn: 0.1 to 1.0%, Al: 0.01% or less, Ti: 0.01% or less, one or both of W: 0.005 to 0.2% and Mo: 0.003 to 0.2%, N: 10 to 30 ppm, B: 4 to 30 ppm (of which, solute B is 3 ppm or more), and O: 10 to 40 ppm, having a balance of Fe and unavoidable impurities, having an area percentage of pearlite structures of 97% or more, having a balance of non-pearlite structures comprising bainite, degenerated pearlite and proeutectoid ferrite, and having a total of the area percentage of the non-pearlite structures and the area percentage of the coarse pearlite structures where the apparent lamellar spacing is 600 nm or more of 15% or less.

(2) Steel rod for high strength steel wire superior in ductility as set forth in (1) characterized by further containing as components, by mass %, at least one of Cr: 0.5% or less, Ni: 0.5% or less, Co: 0.5% or less, V: 0.5% or less, Cu: 0.2% or less, and Nb: 0.1% or less.

(3) High strength steel wire superior in ductility obtained by the process comprising patenting, then drawing a steel rod set forth in (1) or (2), said steel wire characterized by having a tensile strength of 3600 MPa or more and a number density of voids of lengths of 5 μm or more of 100/mm$^2$ or less at the center.

(4) A method of producing steel rod for high strength steel wire superior in ductility as set forth in (1) or (2), characterized by hot rolling a steel billet of the chemical components set forth in (1) or (2) into a steel rod having a diameter of 3 to 7 mm, coiling this steel rod at a temperature region of 800 to 950° C., then patenting it by a cooling method giving a cooling rate of 20° C./s or more while being cooled from 800° C. to 700° C.

(5) A method of producing high strength steel wire superior in ductility as set forth in (3), characterized by drawing the steel rod produced by the method of production as set forth in (4), then patenting it, then further cold drawing it.

By application of the present invention, high strength steel wire superior in ductility, in particular twistability, used in steel cord and sawing wires can be obtained with high productivity and good yield in low cost from high strength steel rod superior in ductility.

BEST MODE FOR CARRYING OUT THE INVENTION

The inventors investigated and researched the influences of voids, which are formed during the process of drawing a steel rod and remained in the steel wire after drawing, on the ductility of the steel wire and obtained the following discoveries.

(a) Drawability generally rises by reducing the amount of C and increasing a soft phase, that is ferrite, degenerated pearlite and bainite (hereinafter referred to as the "non-pearlite structures"). This is because strain from working concentrates to the soft non-pearlite structures dispersed in a network, and the work hardening proceeds macroscopically uniformly.

Figure 7:
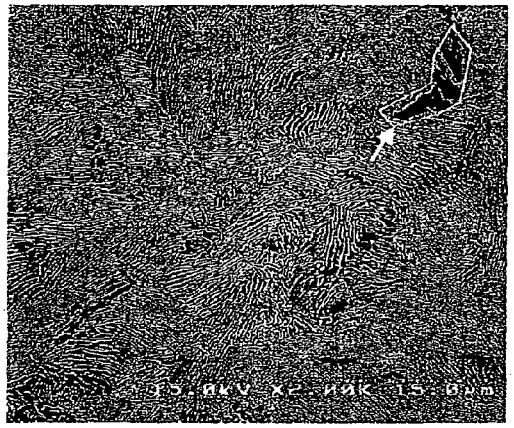
FIG. 7 is a view using photographs for explaining the structure of the steel rod, where (a) shows an example of a non-pearlite structure and (b) an example of a coarse pearlite structure.
Figure 7:
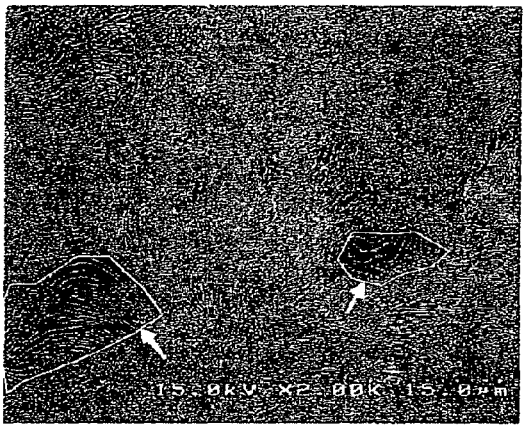

However, if increasing the amount of C to 0.7% or more, particularly to 0.8% or more, to stably obtain high strength steel wire, the non-pearlite structure decreases and disperses. FIG. 7(*a*) shows an example of such non-pearlite structures.

Figure 8:
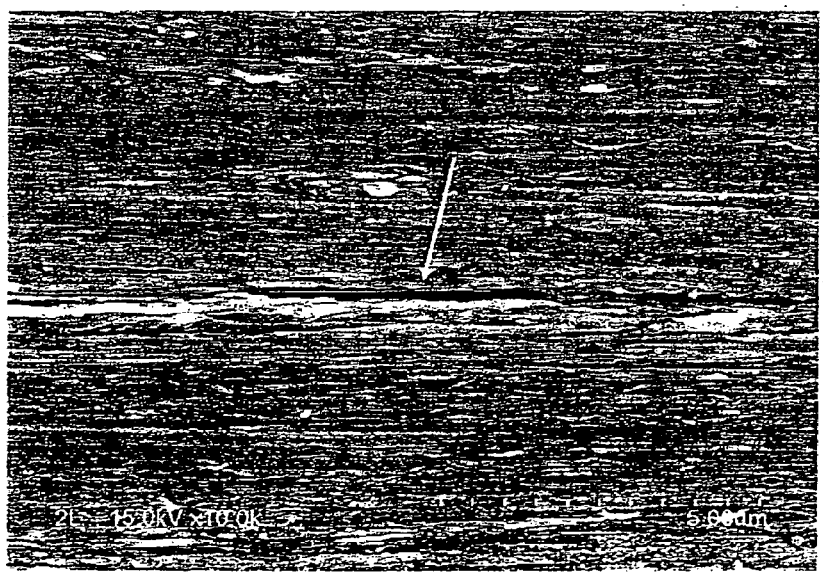
FIG. 8 is a view using photographs for explaining the coarse voids formed in steel wire after drawing.

Large strain locally concentrates to such dispersed non-pearlite structures during drawing whereby voids are formed early on. In particular, if large non-pearlite structures disperse, coarse voids will be formed and will remain during subsequent intermediate patenting and final drawing and thereby degrade the drawability. FIG. 8 shows an example of coarse voids.

(b) Coarse pearlite structures of which lamellar spacing is several times greater than the average lamellar spacing are soft and degrade the drawability at the final drawing for the same reasons as the above.

At the time of Stelmor patenting after steel rod rolling and coiling, the cooling rate at the ring overlapping area of the coiled steel rod might be low. It is considered that such coarse pearlite forms at a comparatively high temperature due to the low-cooling rate.

To suppress deterioration of ductility during drawing, reduction of the area fraction of the coarse pearlite structures to suppress the formation of coarse voids is effective. According to the results of SEM observation, if structures where the apparent lamellar spacing is 600 nm or more (hereinafter referred to as "coarse pearlite") increase, the voids increase in drawn wire. Note that, FIG. 7(*b*) shows an example of a coarse pearlite structure.

(c) To suppress the formation of voids caused by non-pearlite structures and coarse pearlite and suppress the deterioration of ductility during drawing, making the pearlite area percentage 97% or more and making the total of the non-pearlite area percentage and the coarse pearlite area percentage 15% or less is effective.

(d) Mo and W concentrate at the interface of the pearlite and base phase austenite and have the effect of suppressing the growth of pearlite by so-called solute drag. By appropriately adding these elements, it is possible to suppress only the growth of the pearlite in a 600° C. or higher temperature region and possible to decrease coarse pearlite by using the conventional facilities without reducing productivity.

Further, Mo and W also have the effect of increasing hardenability and suppressing formation of ferrite and are effective in reducing non-pearlite structures.

However, if these elements are excessively added, pearlite growth in all temperature regions will be suppressed, the patenting will require a long time, and the productivity will be lowered. Also, coarse $Mo_2C$ carbides and $W_2C$ carbides will precipitate and the drawability will drop.

(e) B segregates at the austenite grain boundaries and suppresses the formation of ferrite, degenerated pearlite, bainite and other non-pearlite structures formed from the austenite grain boundary during cooling from the austenite temperature at patenting and suppresses the formation of coarse pearlite by the effect of improvement of the hardenability.

B forms compounds with N, so the amount of B segregated at the grain boundaries is determined by the total amount of B, amount of N, and the heating temperature before pearlite transformation. If the amount of solute B is low, the above effects are small, and if excessive, coarse $Fe_{23}(CB)_6$ precipitates before pearlite transformation and the drawability will deteriorate.

(f) By simultaneously adding one or both of Mo and W and B and patenting under heat treatment conditions where solute B can be secured, formation of non-pearlite structures and coarse pearlite are further suppressed.

(g) Steel wire drawn using steel rod where the area percentage of the non-pearlite structures and the coarse pearlite is suppressed and as a result formation of coarse voids is suppressed is superior in twistability. In particular, voids with a length of 5 μm or more in the steel wire may develop into cracks. If the number density of such voids can be suppressed to 100/mm$^2$ or less, wire breakage when twisting the wires together can be suppressed.

The present invention was made based on the above findings. Below, the present invention will be sequentially explained. Note that, in the explanation below, the % and ppm of the contents of the components mean mass % and mass ppm respectively.

Concerning Structures and Voids of Steel Rod:

The steel rod is patented by controlled cooling after hot rolling and coiling and made pearlite structures of an area percentage of 97% or more and a balance of non-pearlite structures comprising bainite, degenerated pearlite, and proeutectoid ferrite. This is because if less than 97%, the necessary steel rod strength cannot be secured and the ductility during drawing will deteriorate.

Pearlite transformation proceeds by the nucleation of pearlite at austenite grainboundaries and growth of pearlite. Until layered structures forming the nuclei of pearlite structures are formed, the structures are non-pearlite ones with irregular growth of ferrite and cementite, so the steel rod will usually never have 100% pearlite structures.

The direct drawability of the patented rolled steel rod is correlated with the area percentage of the non-pearlite structures and the coarse pearlite structures in the steel rod. If the total of the area percentages of the non-pearlite structures and coarse pearlite structures can be suppressed to 15% or less, early void formation during drawing is suppressed, and the drawability (ductility) during final drawing after intermediate patenting is improved.

Further, if the total of the area percentages of the non-pearlite structures and coarse pearlite structures of the steel rod is made 15% or less, the number density of coarse voids remaining in the steel wire after drawing decreases, the ductility of the steel wire rises, and breakage during twisting becomes extremely infrequent.

The voids remaining in the steel wire are elongated long in the drawing direction as shown in FIG. 8. According to a study by the inventors, it is revealed that what affects the ductility of steel wire are the coarse voids having a length of 5 μm or more, and that if making the total of the area percentages of the non-pearlite structures and the coarse pearlite structures of the steel rod 15% or less, the number density of such voids becomes 100/mm$^2$ or less at the center of the steel wire, and the twistability of the steel wire is improved.

Figure 1:
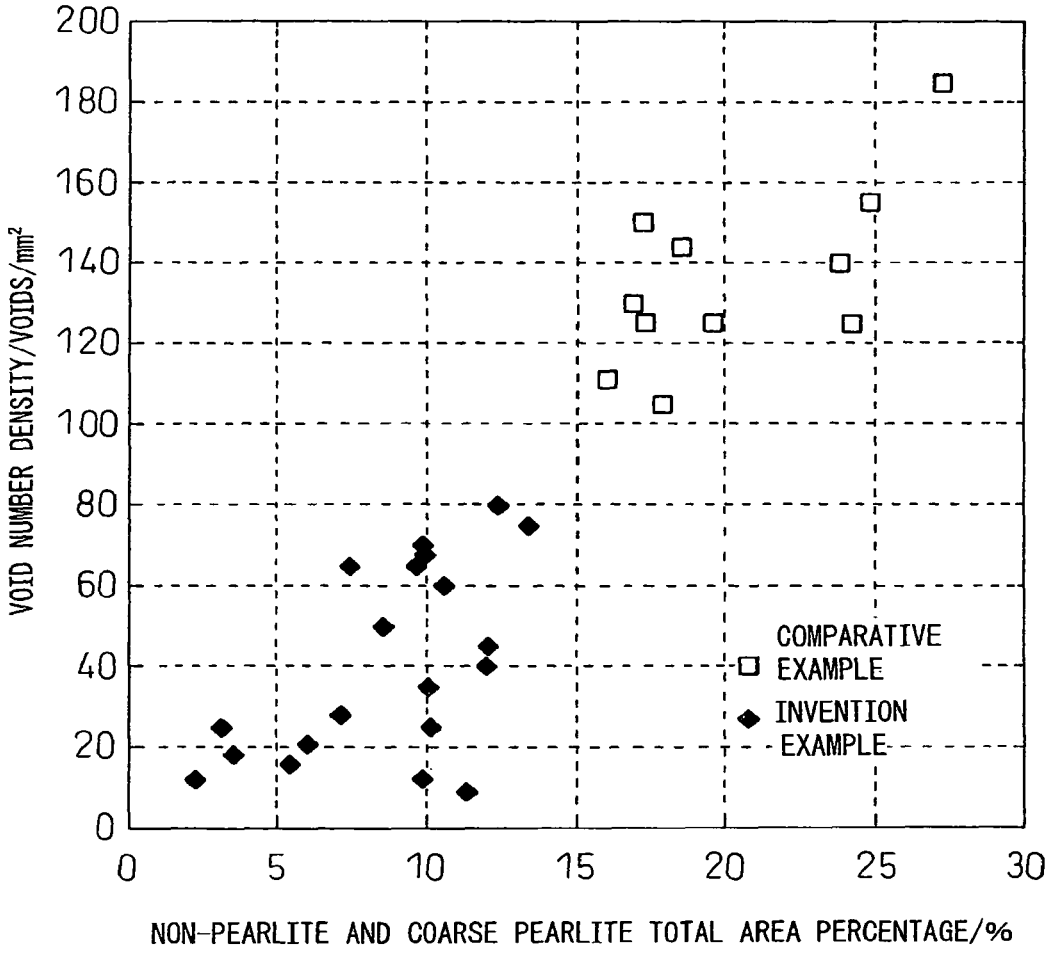
FIG. 1 is a view showing the relationship between the total value of the area percentages of the coarse pearlite and the non-pearlite of a rolled steel rod using steel containing Mo and the void number density after drawing.
Figure 2:
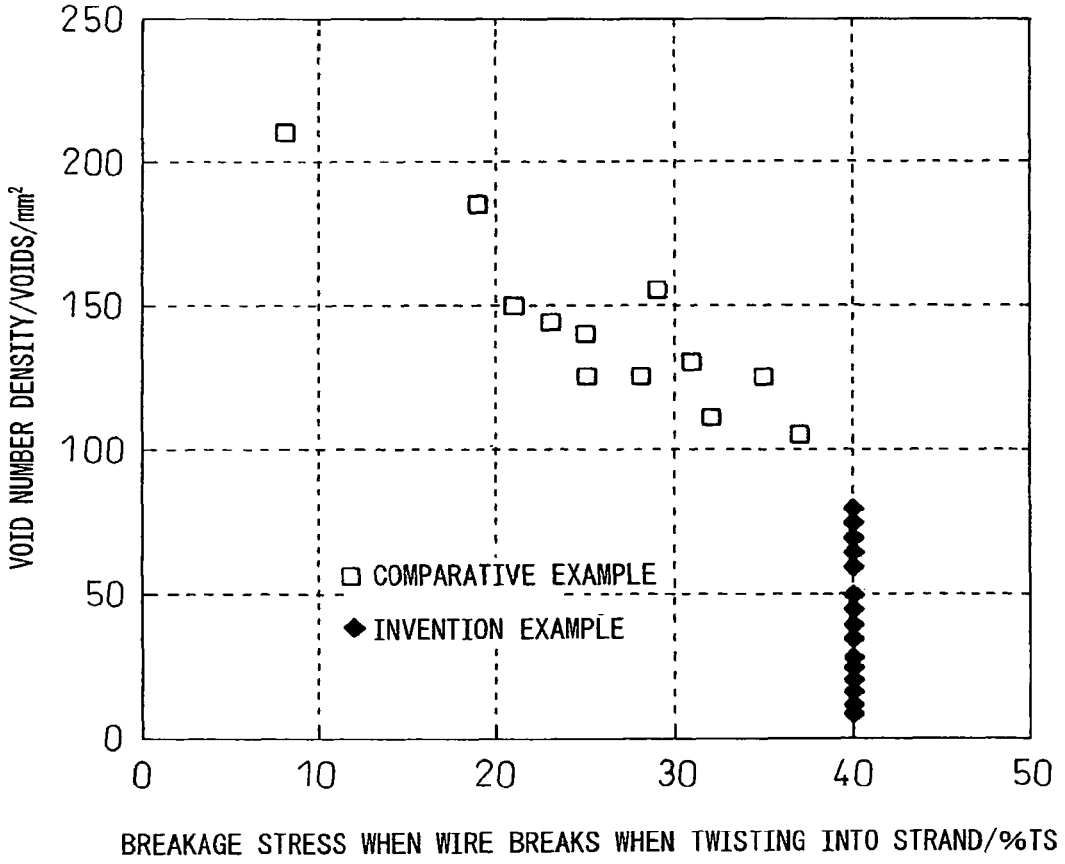
FIG. 2 is a view showing the relationship between the void number density of steel wire using steel containing Mo and breakage stress when a stranded steel wirebreaks during twisting (40% means no breakage).

FIG. 1 shows the relationship between the total of the area percentages of the non-pearlite structures and coarse pearlite structures of a steel rod before drawing and the number density of the coarse voids of the steel wire after drawing prepared using the values obtained from Example 1 explained later (example using steel containing Mo alone). Further, FIG. 2 shows the relationship between the number density of coarse voids of steel wire and the breakage stress when a stranded wire breaks during twisting (40% means no breakage) prepared in the same way.

These drawings show that if the total of the area percentages of the non-pearlite and the coarse pearlite of the steel rod is made 15% or less, the number density of coarse voids of the steel wire will become 100/mm$^2$ or less and twisting without breakage can be performed.

To reduce the non-pearlite structures and coarse pearlite structures, it is effective to control the amounts of C, Si, and Mn in the steel billet or slab to predetermined ranges and, as in the above, simultaneously add one or both of Mo and W and B in ranges of Mo: 0.003 to 0.2%, W: 0.005 to 0.2%, and B: 4 to 30 ppm, then hot roll the steel billet to a 3 to 7 mm rod size and coil it at a 800 to 950° C. temperature region, then patent it by a cooling method giving a cooling rate of 20° C./s or more while being cooled from 800° C. to 700° C.

Figure 3:
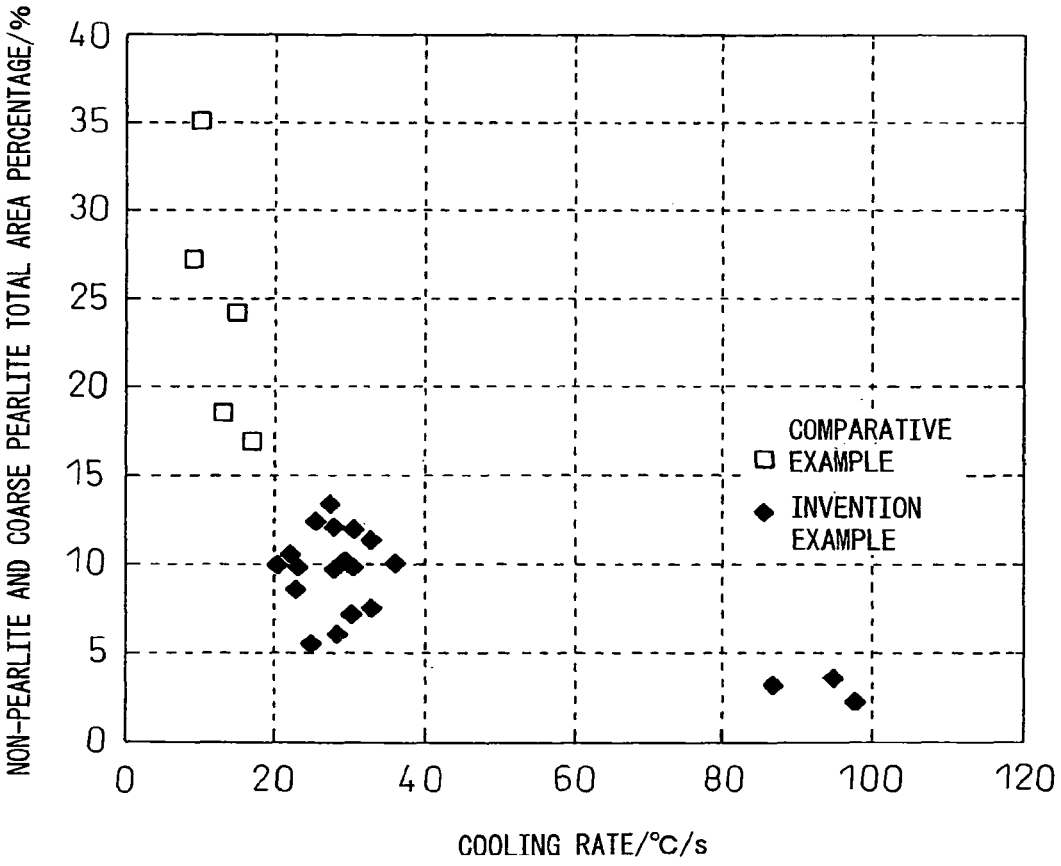
FIG. 3 is a view showing the relationship between the cooling rate between 800 to 700° C. after coiling of rolled steel rod using steel containing Mo and the total value of the area percentages of the coarse pearlite and non-pearlite after cooling.

FIG. 3 shows the relationship between the cooling rate between 800 to 700° C. at patenting and the total of the area percentages of the non-pearlite structures and coarse pearlite structures after patenting obtained by the later explained Example 1.

If making the cooling rate less than 20° C./s, even if steel having the above chemical components is used, B precipitates as BN, and the amount of solute B decreases, thereby making it difficult to suppress the non-pearlite structures and coarse pearlite structures. A preferable cooling rate is 25° C./s or more. The upper limit of the cooling rate is not particularly limited, however, if the cooling rate is made too high, the tensile strength (TS) after pearlite transformation will become higher than necessary and the direct drawability will be deteriorated, therefore 50° C./s or less is preferable.

To control the cooling rate, in a Stelmor system, air blowers are concentratedly arranged at the ring overlapping parts, blowers are mounted at the both sides of conveyer, and the like, so as to control the cooling rate at the ring overlapping parts to 20° C./s or more.

Note that, the lamellar spacing of the pearlite structures depends on transformation temperature. Coarse pearlite having large lamellar spacing is estimated to form near 650° C. In the actual production process of a ring-shaped steel rod, there will always be ring overlapping parts. At the overlapping parts, the cooling rate inevitably falls from the surrounding average locations, so even if the cooling rate of the austenite temperature region is controlled to 20° C./s or more, suppressing local rise up to near 650° C. at the overlapping parts becomes extremely difficult. Therefore, even if the formation of coarse pearlite can be suppressed by adding Mo or W and B, it can be said to be impossible to make it zero.

In the above, the coiling temperature range was specified to be a 800 to 950° C. temperature region for the purpose of securing descaling property as well as suppressing the precipitation of B carbides and nitrides to secure solute B and suppressing the coarsening of austenite grain size so as to refine the non-pearlite structures and coarse pearlite structures and refine the size of voids formed from these structures.

Chemical Components of Steel Rod and Steel Wire:

C: C is an element effective in increasing strength. If the content of this is less than 0.80%, it becomes difficult to stably give a high strength of 3600 MPa or more to a final product steel wire and, at the same time, formation of proeutectoid ferrite is accelerated at the austenite grain boundaries and it becomes difficult to obtain the necessary pearlite structure area percentage. On the other hand, if increasing the content of C over 1.20%, not only net-shaped proeutectoid cementite form at the austenite grain boundaries and make breakage occur easily during drawing, but also the toughness and ductility of the ultrafine wire after final drawing is significantly deteriorated. Accordingly, the content of C was made 0.80 to 1.20%.

Si: Si is an element effective for increasing strength. Further, it is an element useful as a deoxidizing agent and an element necessary when dealing with steel not containing Al. If its content is less than 0.1%, the deoxidizing effect is too small. On the other hand, if increasing the amount of Si over 1.5%, the formation of proeutectoid ferrite is accelerated even in hypereutectoid steel and the drawability deteriorates. Further, a drawing process using mechanical descaling (hereinafter abbreviated as "MD") becomes difficult. Accordingly, the content of Si was made 0.1 to 1.5%. The preferable upper limit for the amount of Si is less than 0.6%, more preferably less than 0.35%.

Mn: Mn, like Si, is an element useful as a deoxidizing agent. Further, it is effective in improving hardenability and increasing the strength of steel rod. Further, Mn fixes the S in the steel as MnS and prevents hot embrittlement. If the content is less than 0.1%, it is difficult to obtain this effect. On the other hand, if the content exceeds 1.0%, it segregates at the center of the steel rod and causes martensite and bainite formation during or after patenting, whereby the drawability deteriorates. Accordingly, the content of Mn was made 0.1 to 1.0%.

Al: Al forms hard non-deforming Al-based nonmetallic inclusions and causes for ductility deterioration and drawability deterioration, therefore, so as not to cause such deterioration, the content of Al was made 0.01 or less, including 0%.

Ti: Ti forms hard non-deforming oxides and causes for ductility deterioration and drawability deterioration, therefore, so as not to cause such deterioration, the content of Ti was made 0.01 or less, including 0%.

Mo and W: Mo and W concentrate at the interface between the pearlite and the base phase austenite and have the effect of suppressing the growth of pearlite by the so-called solute drag. They are added alone or in combination.

By adding 0.003% or more of Mo or 0.005% or more of W, it is possible to suppress only the growth of pearlite in a high temperature region of 600° C. or more, and formation of coarse pearlite can be suppressed. Further, Mo and W have the effect of improving hardenability and are effective also in suppressing the formation of ferrite and reducing non-pearlite structures.

However, if either is added excessively over 0.2%, pearlite growth in all temperature regions will be suppressed, the patenting will take a long time, and productivity will be lowered. Also, coarse $Mo_2C$ carbide and $W_2C$ carbide will precipitate, then the drawability will deteriorate.

Accordingly, the content of Mo was made 0.003 to 0.2% and the content of W was made 0.005 to 0.2%. When both Mo and W are added, the total amount is preferably made 0.2% or less, further preferably 0.16% or less.

The preferable range of Mo is 0.01% to 0.15%, more preferably 0.02% to 0.10%, further preferably 0.04% to 0.08%.

Further, the preferable range of W is 0.01% to 0.15%, more preferably 0.02% to 0.10%, further preferably 0.04% to 0.08%.

N: N forms nitrides with B in the steel and has the effect of preventing the coarsening of austenite grain size when heating. This effect is effectively exhibited by including 10 ppm or more of this. However, if the content increases too much exceeding 30 ppm, the amount of nitrides increases excessively and decreases the amount of solute B in the austenite. Further, solute N is liable to accelerate aging during drawing. Accordingly, the content of N was made 10 to 30 ppm.

O: O forms complex inclusions with Si and the like and thereby is able to form soft inclusions not having negative effects on drawability. Such soft inclusions can be finely dispersed after hot rolling. Due to the pinning effect, it has the effect of refining the γ grain size and improving the ductility of the patented steel rod. Therefore, the lower limit was made a value larger than 10 ppm. However, if increasing the content too much over 40 ppm, hard inclusions are formed and the drawability deteriorates, therefore the content of O was made over 10 ppm to 40 ppm.

Note that, when including Mo alone, it is preferable to include O in an amount over 20 ppm.

B: When B exists in a solid solution state in the austenite, it concentrates at the grain boundaries and suppresses the formation of ferrite, degenerated pearlite, bainite, and other non-pearlite structures. Therefore, 3 ppm or more of solute B is necessary. On the other hand, if overly adding B, this will accelerate the precipitation of coarse $Fe_3(CB)_6$ carbides in the austenite and have a negative effect on drawability. To satisfy the above, the lower limit of the content of B was made 4 ppm, and the upper limit was made 30 ppm (of which, 3 ppm or more is solute B).

The preferable range of B is 6 ppm to 20 ppm, more preferably 8 ppm to 15 ppm, further preferably 10 ppm to 13 ppm. Further, the preferable range of solute B is 5 ppm to 15 ppm, more preferably 6 ppm to 12 ppm, further preferably 8 ppm to 10 ppm.

P and S: These are impurities. Their contents are not particularly stipulated, however, from the viewpoint of similarly securing ductility as with conventional ultrafine steel wire, it is preferable for each to be no more than 0.02%.

The steel used in the present invention has the above elements as its basic chemical components, however, one or two of the following elements may be actively added for the purpose of further improving strength, toughness, ductility, and other mechanical characteristics.

Cr: 0.5% or less, Ni: 0.5% or less, Co: 0.5% or less, V: 0.5% or less, Cu: 0.2% or less, and Nb: 0.1% or less.

Below, each element will be explained.

Cr: Cr is an element effective in refining lamellar spacing of pearlite, improving the strength of the steel rod and the drawability of the steel rod. To effectively exhibit such an effect, it is preferable to add 0.1% or more. On the other hand, if the amount of Cr is too large, the transformation completion time will become long and martensite, bainite, and other overcooled structures will be liable to form in the steel rod after patenting. Further, the mechanical descaling property also becomes worse. Therefore, the upper limit when adding is made 0.5%.

Ni: Ni is an element that does not contribute much to increasing the strength of the steel wire, but increases toughness. To effectively exhibit such an effect, it is preferable to add 0.1% or more. On the other hand, if excessively adding Ni, the transformation completion time will become long, therefore the upper limit when adding it is made 0.5%.

Co: Co is an element effective in suppressing precipitation of proeutectoid cementite in the rolled steel rod. To effectively exhibit such an effect, it is preferable to add 0.1% or more. On the other hand, even if excessively adding Co, its effect becomes saturated and the result is economically wasteful, therefore the upper limit when adding it is made 0.5%.

V: V forms fine carbonitrides in the ferrite, whereby it prevents the coarsening of austenite during heating as well as contributes to increasing strength after rolling. To effectively exhibit such an effect, it is preferable to add 0.05% or more. However, if excessively adding it, the amount of carbonitrides formed will become too excessive and the grain size of the carbonitrides will become larger, therefore the upper limit when adding it is made 0.5%.

Cu: Cu has an effect of increasing the corrosion resistance of the steel wire. To effectively exhibit such an effect, it is preferable to add 0.1% or more. However, if excessively adding it, it will react with S and CuS will precipitate at the grain boundaries, so defects will be caused on the steel ingot or the steel rod and the like during the production process. To prevent such negative effects, the upper limit when adding it is made 0.2%.

Nb: Nb has an effect of increasing the corrosion resistance of the steel wire. To effectively exhibit such an action, it is preferable to add 0.05% or more. On the other hand, if excessively adding Nb, the transformation completion time will become long, therefore the upper limit when adding it is made 0.1%.

Conditions for Producing Rolled Steel Rod:

A steel billet (steel slab) comprised of the above chemical components is heated, then is hot rolled into a rod having a diameter of 3 to 7 mm according to the final product size. At that time, as explained above, the coiling temperature is made a temperature range of 800 to 950° C. In the cooling after coiling, the cooling rate from 800° C. to 700° C. is made 20° C./s or more, whereby the formation of proeutectoid ferrite and coarse pearlite are suppressed.

Drawing Conditions:

Steel rod superior in ductility produced under the above production conditions and satisfying the above conditions of the chemical components and the structure is cold drawn and patented by final patenting once during that time, then is drawn by final cold drawing to obtain high strength steel wire having a tensile strength of 3600 MPa or more and having a number density of 100/mm$^2$ or less of voids of a length of 5 μm or more in the center of the steel wire. During this time, the true strain of cold drawing is 3 or more, preferably 3.5 or more.

EXAMPLES

Next, examples will be given to explain the present invention in more detail, however, the present invention is not limited to the following examples and can of course be carried out with changes added appropriately within the range meeting the gist of the present invention. These are all within the technical scope of the present invention.

Example 1

This is an example of the case using steel containing Mo. A billet using steel having each of the chemical components shown in Table 1 was heated, then hot rolled to rod having a diameter of 3 to 7 mm. The hot rolled rod was coiled in a ring shape at a predetermined temperature, then patented by the Stelmor treatment.

When patenting by the Stelmor treatment, the cooling rate at the overlapping part of the steel rod decreases, whereby the transformation temperature rises and coarse pearlite is easily formed. The cooling rate from 800° C. to 700° C. was obtained by measuring the temperature of the ring overlapping part using a non-contact type thermometer every 0.5 m on a Stelmor conveyor, then measuring the required time t for cooling from 800° C. to 700° C. The cooling rate was found to be (800-700)/t.

The patented rolled rod was cut to samples which were subjected to tensile tests. Also, to measure the area percentages of the non-pearlite structures and coarse pearlite structures, ring-shaped steel rod having a ring diameter of 1.0 to 1.5 m were cut into eight equal parts, these eight samples were cut to samples of 10 mm length which were embedded in a resin so that the cross-sections of the center parts along the longitudinal direction of the rod (L direction) can be observed, abraded by alumina, corroded by saturated picral, and observed by SEM.

The observation region of SEM was made a 1/4D portion. A 200×300 μm region was observed by 2000×. The area percentages of the degenerated pearlite structure in which ceminite was dispersed in a grain shape, the bainite parts in which plate-shaped cementite was coarsely dispersed at spacings of 3 times or more the spacings of the surrounding pearlite lamellar spacings, and the proeutectoid ferrite parts formed along the austenite grainboundaries were measured by image analysis as non-pearlite structures. Further, the area percentage of coarse pearlite structures having a lamellar spacing of 600 nm or more was measured by an image analysis system. These measurements were carried out using the above eight samples, and the average values and maximum values were found.

To obtain the drawing characteristics of the steel rod, the scale of the patented rolled rod was removed by pickling, then bonderization was used to impart a zinc phosphate coating. A 10 m long steel rod was prepared. This was drawn by single-head type drawing by an area reduction of 16 to 20% per pass, patented once or twice by a lead bath (LP) or fluidized bed patenting (FBP), then drawn by wet continuous drawing until a wire size of 0.15 to 0.3 mm to obtain steel wire having the final drawing size. Samples were taken from the obtained steel wire and subjected to a tensile test and measured for number density of voids.

The number density of voids in the drawn steel wire was obtained by embedding and abrading a 10 mm long steel wire so that the L cross-section center part could be observed, corroding it by saturated picral, using SEM to photograph a 10 mm long, 20 μm wide region of the center of the steel rod at 5000×, measuring the number of voids of lengths of 5 μm or more, and dividing this by the observation area.

Next, the prepared steel wire was twisted into strands to investigate the occurrence of breakage and breakage stress. Twisting speed was 10000 rpm and the applied load was increased gradually up to 40% of tensile strength of steel wires. The breakage stress is shown by the ratio of the tensile strength when breakage occurred with respect to the steel wire strength TS. Under the above working conditions, 40% exhibited no breakage.

The results are shown in Table 2. In Table 2, Nos. 1 to 29 are results using steels of the corresponding Nos. 1 to 29 of Table 1. Nos. 1 to 16 are invention examples, and Nos. 17 to 29 are comparative examples. The entries of "-" in the characteristics column of the steel wires of the comparative examples are cases where the wire broke at the final drawing pass or a prior pass. The final drawing diameter is the diameter at the time of that pass.

Based on the values of Table 2, FIG. 1 shows the relationship between the total value of the area percentages of the non-pearlite structures and coarse pearlite structures and the number density of the voids of the steel wire after final drawing, while FIG. 2 shows the relationship between the number density of the voids of the steel wire and the breakage stress when a wire breaks from twisting. Further, FIG. 3 shows the relationship between the cooling rate at 800 to 700° C. of the steel rod after coiling and the total of the area percentages of the coarse pearlite structures and the non-pearlite structures.

FIG. 1 shows that in the invention examples, if suppressing the non-pearlite and coarse pearlite percentage to 15% or less, in the drawn steel wire, the formation of voids lengths of 5 μm or more can be suppressed to 100/mm$^2$ or less, further, FIG. 2 shows that in the invention examples, if suppressing the formation of voids to 100/mm$^2$ or less, the wire can be twisted into strands without wire breakage. Further, FIG. 3 shows that by making the cooling rate in the steel rod at 800 to 700° C. 20° C./s or more, the non-pearlite and coarse pearlite percentage to be suppressed to 15% or less.

As shown in Table 2, in the invention examples, steel wires were obtained having high tensile strength without any wire breakage, and the steel wires could be twisted into strands without wire breakage due to the twisting.

As opposed to this, in the comparative examples, there were the following problems. Either the wire broke during drawing or broke during twisting into strands after drawing.

17 is an example where the coiling temperature was low, therefore B nitrides and carbides precipitated before patenting and the amount of solute B could not be secured, so the non-pearlite and the coarse pearlite could not be suppressed.

18 is an example where the amount of B was low, so the non-pearlite and the coarse pearlite could not be suppressed.

19 is an example where the amount of B was excessive, a large amount of B carbides and proeutectoid cementite ended up precipitating at the austenite grain boundaries, and the drawability was inferior.

20 is an example where the amount of Si was excessive and non-pearlite (proeutectoid ferrite) precipitation could not be suppressed.

21 is an example where the amount of C was excessive and proeutectoid cementite precipitation could not be suppressed, so the wire could not be drawn due to wire breakage.

22 is an example where the amount of Mn was excessive and pearlite transformation did not finish during Stelmore process, so the drawability deteriorated and the wire broke.

23 is an example where the coiling temperature after rolling was too high, so BN precipitated in a large amount during the cooling process and, further, the austenite grains became coarsened, so coarse grain boundary ferrite formed and the ductility deteriorated.

24 is an example where the amount of Mo was excessive and the pearlite transformation did not finish during Stelmore process, so primary drawing could not be performed.

25 to 27 are examples where B was not added, so the non-pearlite and the coarse pearlite could not be suppressed.

28 is an example where the cooling rate after coiling was small, so the tensile strength (TS) was also low and the non-pearlite and coarse pearlite were both large in amount.

29 is an example where no Mo was added, so the formation of coarse pearlite could not be suppressed.

TABLE 1

| | Element (mass %, mass ppm) | | | | | | | | | |
|---|---|---|---|---|---|---|---|---|---|---|
| No. | C | Si | Mn | P | S | B (ppm) | Solute B (ppm) | Al | Ti | N (ppm) |
| 1 | 0.82 | 0.30 | 0.45 | 0.019 | 0.025 | 24 | 11 | | 0.001 | 20 |
| 2 | 0.82 | 0.20 | 0.51 | 0.015 | 0.013 | 13 | 9 | | 0.001 | 22 |
| 3 | 0.92 | 0.20 | 0.57 | 0.010 | 0.007 | 12 | 8 | | 0.004 | 20 |
| 4 | 0.92 | 0.20 | 0.3 | 0.019 | 0.025 | 8 | 6 | | | 27 |
| 5 | 0.93 | 0.20 | 0.32 | 0.008 | 0.007 | 11 | 7 | 0.003 | | 26 |
| 6 | 0.92 | 0.20 | 0.49 | 0.010 | 0.009 | 9 | 6 | | | 24 |
| 7 | 0.92 | 0.60 | 0.5 | 0.025 | 0.020 | 8 | 5 | 0.001 | | 25 |
| 8 | 1.02 | 0.20 | 0.3 | 0.008 | 0.008 | 11 | 6 | | | 27 |
| 9 | 1.02 | 0.18 | 0.3 | 0.008 | 0.008 | 12 | 7 | | | 26 |
| 10 | 1.02 | 0.20 | 0.5 | 0.008 | 0.008 | 13 | 7 | 0.004 | | 25 |
| 11 | 1.02 | 0.20 | 0.5 | 0.010 | 0.008 | 4 | 3 | | | 25 |
| 12 | 1.02 | 0.20 | 0.5 | 0.008 | 0.010 | 12 | 8 | | | 27 |
| 13 | 0.92 | 0.20 | 0.4 | 0.008 | 0.008 | 15 | 11 | | | 25 |
| 14 | 0.91 | 0.20 | 0.3 | 0.008 | 0.008 | 21 | 13 | | 0.003 | 26 |
| 15 | 0.90 | 0.20 | 0.49 | 0.009 | 0.010 | 9 | 6 | | | 21 |
| 16 | 1.12 | 0.22 | 0.3 | 0.008 | 0.008 | 28 | 19 | 0.001 | | 27 |
| 17 | 0.82 | 0.30 | 0.5 | 0.008 | 0.007 | 11 | 6 | | | 35 |
| 18 | 0.82 | 0.20 | 0.5 | 0.010 | 0.009 | 2 | | | 0.010 | 50 |
| 19 | 0.90 | 0.20 | 0.8 | 0.010 | 0.009 | 60 | 32 | | 0.005 | 25 |
| 20 | 0.87 | 1.70 | 0.4 | 0.015 | 0.013 | 20 | 11 | | 0.010 | 25 |
| 21 | 1.30 | 1.00 | 0.3 | 0.015 | 0.013 | 20 | 12 | 0.030 | | 25 |
| 22 | 0.92 | 0.30 | 1.5 | 0.015 | 0.013 | 20 | 10 | 0.025 | | 25 |
| 23 | 0.82 | 1.00 | 0.5 | 0.025 | 0.020 | 20 | 13 | 0.030 | | 35 |
| 24 | 0.96 | 0.20 | 0.5 | 0.010 | 0.009 | 12 | 7 | | 0.010 | 25 |
| 25 | 0.82 | 0.20 | 0.5 | 0.010 | 0.009 | | | | 0.010 | 25 |
| 26 | 1.02 | 0.20 | 0.5 | 0.010 | 0.009 | | | | 0.010 | 25 |
| 27 | 0.92 | 0.20 | 0.5 | 0.010 | 0.009 | | | | 0.010 | 25 |
| 28 | 0.82 | 0.20 | 0.45 | 0.019 | 0.025 | 24 | 19 | | | 25 |
| 29 | 0.93 | 0.20 | 0.31 | 0.008 | 0.007 | 11 | 8 | 0.001 | | 26 |

| | Element (mass %, mass ppm) | | | | | | | | |
|---|---|---|---|---|---|---|---|---|---|
| No. | O (ppm) | Mo | Cr | Ni | Cu | V | Co | Nb | Remarks |
| 1 | 21 | 0.005 | | | | | | | Inv. ex. |
| 2 | 31 | 0.186 | | | | | | | Inv. ex. |
| 3 | 28 | 0.040 | | 0.10 | | | | | Inv. ex. |
| 4 | 25 | 0.030 | 0.18 | | | | | | Inv. ex. |
| 5 | 23 | 0.003 | 0.22 | | | | | | Inv. ex. |
| 6 | 24 | 0.025 | | | 0.10 | | | | Inv. ex. |
| 7 | 23 | 0.050 | | | | 0.03 | | 0.05 | Inv. ex. |
| 8 | 21 | 0.005 | 0.23 | | | | | | Inv. ex. |

TABLE 1-continued

| | | | | | | | | | |
|---|---|---|---|---|---|---|---|---|---|
| 9 | 26 | 0.030 | 0.18 | | | | | | Inv. ex. |
| 10 | 21 | 0.060 | 0.21 | | | | | | Inv. ex. |
| 11 | 38 | 0.020 | 0.05 | | | | 0.10 | | Inv. ex. |
| 12 | 22 | 0.110 | 0.20 | | | | | | Inv. ex. |
| 13 | 21 | 0.030 | | | | 0.06 | | | Inv. ex. |
| 14 | 24 | 0.050 | 0.20 | | 0.20 | | | 0.02 | Inv. ex. |
| 15 | 23 | 0.004 | | | | | | | Inv. ex. |
| 16 | 35 | 0.042 | | | | | | | Inv. ex. |
| 17 | 22 | 0.010 | 0.20 | | | | | | Comp. ex. |
| 18 | 28 | 0.030 | | | | | | | Comp. ex. |
| 19 | 18 | 0.015 | | 0.10 | | | | | Comp. ex. |
| 20 | 22 | 0.012 | | | | | | | Comp. ex. |
| 21 | 17 | 0.020 | | | | | 0.30 | | Comp. ex. |
| 22 | 21 | 0.018 | | | | 0.20 | | | Comp. ex. |
| 23 | 20 | 0.018 | | | | 0.20 | | | Comp. ex. |
| 24 | 23 | 0.250 | | | | 0.10 | | | Comp. ex. |
| 25 | 24 | 0.005 | | | | | | | Comp. ex. |
| 26 | 22 | 0.010 | | | | | | | Comp. ex. |
| 27 | 20 | 0.050 | | | | | | | Comp. ex. |
| 28 | 19 | | | | | | | | Comp. ex. |
| 29 | 23 | | 0.22 | | | | | | Comp. ex. |

Note:

Blanks indicate no addition.

TABLE 2

| | Steel rod production conditions | | | | Characteristics of rolled steel rod after patenting | | | | Final patenting conditions and characteristics | |
|---|---|---|---|---|---|---|---|---|---|---|
| No. | Dimameter/ mm | Coil. temp./ ° C. | Cool. method | 800 to 700° C. cooling rate/ ° C./s | Rolled rod. strength/ MPa | Non-pearl. area per./% | Coarse pearl. area per./% | Non-pearl. and coarse pearl. total | Pat. wire diameter/ mm | Pat. method |
| 1 | 5.5 | 860 | Stelmor | 25.5 | 1184 | 2.8 | 9.6 | 12.4 | 1.46 | LP |
| 2 | 5.5 | 880 | Stelmor | 23.3 | 1166 | 2.4 | 7.5 | 9.9 | 1.40 | LP |
| 3 | 5.5 | 860 | Stelmor | 30.5 | 1324 | 1.3 | 5.9 | 7.2 | 1.60 | LP |
| 4 | 5.0 | 820 | Stelmor | 33.0 | 1345 | 2.1 | 5.4 | 7.5 | 1.50 | LP |
| 5 | 3.8 | 855 | Stelmor | 28.0 | 1312 | 1.9 | 10.2 | 12.1 | 1.30 | LP |
| 6 | 6.5 | 895 | Stelmor | 30.8 | 1330 | 2.7 | 9.3 | 12.0 | 1.40 | LP |
| 7 | 5.5 | 820 | Stelmor | 23.0 | 1263 | 2.8 | 5.8 | 8.6 | 1.40 | LP |
| 8 | 5.5 | 860 | Stelmor | 22.3 | 1352 | 1.3 | 9.3 | 10.6 | 1.45 | LP |
| 9 | 5.5 | 870 | Stelmor | 33.0 | 1445 | 2.2 | 9.2 | 11.4 | 1.45 | FBP |
| 10 | 5.5 | 870 | Stelmor | 29.5 | 1420 | 2.6 | 7.6 | 10.2 | 1.30 | LP |
| 11 | 5.5 | 820 | Stelmor | 20.5 | 1341 | 1.9 | 8.1 | 10.0 | 1.50 | LP |
| 12 | 5.5 | 870 | Stelmor | 36.3 | 1478 | 1.9 | 8.2 | 10.1 | 1.45 | LP |
| 13 | 5.5 | 870 | Stelmor | 28.0 | 1304 | 1.9 | 7.8 | 9.7 | 1.40 | LP |
| 14 | 5.5 | 870 | Stelmor | 25.0 | 1266 | 1.2 | 4.3 | 5.5 | 1.60 | FBP |
| 15 | 5.5 | 870 | Stelmor | 27.5 | 1282 | 2.9 | 10.5 | 13.4 | 1.60 | FBP |
| 16 | 5.5 | 860 | Stelmor | 30.5 | 1523 | 2.6 | 7.3 | 9.9 | 0.84 | LP |
| 17 | 5.5 | 750 | Stelmor | 33.0 | 1250 | 4.3 | 15.3 | 19.6 | 1.40 | LP |
| 18 | 5.5 | 870 | Stelmor | 28.0 | 1207 | 4.5 | 20.3 | 24.8 | 1.40 | LP |
| 19 | 5.5 | 860 | Stelmor | 26.0 | 1277 | 4.2 | 17.3 | 21.5 | 1.50 | LP |
| 20 | 5.5 | 900 | Stelmor | 30.0 | 1272 | 8.6 | 8.6 | 17.2 | 1.40 | LP |
| 21 | 5.5 | 820 | Stelmor | 33.0 | 1725 | 4.7 | 7.2 | 11.9 | 1.20 | LP |
| 22 | 5.5 | 820 | Stelmor | 28.5 | 1336 | 3.8 | 9.1 | 12.9 | 1.40 | LP |
| 23 | 5.5 | 970 | Stelmor | 27.3 | 1200 | 2.4 | 8.2 | 10.6 | 1.30 | LP |
| 24 | 5.5 | 870 | Stelmor | 24.0 | 1312 | 2.8 | 8.6 | 11.4 | 1.50 | FBP |
| 25 | 5.5 | 870 | Stelmor | 24.5 | 1176 | 3.4 | 20.4 | 23.8 | 1.50 | LP |
| 26 | 5.5 | 880 | Stelmor | 40.5 | 1515 | 3.8 | 14.1 | 17.9 | 1.45 | LP |
| 27 | 5.5 | 890 | Stelmor | 38.3 | 1396 | 4.2 | 11.8 | 16.0 | 1.60 | LP |
| 28 | 5.5 | 870 | Stelmor | 10.0 | 1049 | 4.1 | 31.0 | 35.1 | 1.46 | LP |
| 29 | 5.5 | 855 | Stelmor | 28.0 | 1312 | 2.5 | 14.8 | 17.3 | 1.30 | LP |

TABLE 2-continued

| No. | Final patenting conditions and characteristics: Pat. temp./° C. | Patent. wire strength/MPa | Steel wire characteristics: Final wire diameter/mm | Final wire strength/MPa | Wire break. in twisting | Twist break. stress (TS ratio %) | Void number density//mm$^2$ | Remarks |
|---|---|---|---|---|---|---|---|---|
| 1 | 575 | 1342 | 0.20 | 3789 | None | 40.0 | 80 | Inv. ex. |
| 2 | 550 | 1315 | 0.22 | 3455 | None | 40.0 | 70 | Inv. ex. |
| 3 | 575 | 1414 | 0.22 | 4055 | None | 40.0 | 28 | Inv. ex. |
| 4 | 600 | 1419 | 0.20 | 4132 | None | 40.0 | 65 | Inv. ex. |
| 5 | 570 | 1422 | 0.22 | 3891 | None | 40.0 | 45 | Inv. ex. |
| 6 | 550 | 1413 | 0.20 | 3971 | None | 40.0 | 40 | Inv. ex. |
| 7 | 575 | 1492 | 0.20 | 4195 | None | 40.0 | 50 | Inv. ex. |
| 8 | 575 | 1529 | 0.20 | 4445 | None | 40.0 | 60 | Inv. ex. |
| 9 | 575 | 1468 | 0.20 | 4266 | None | 40.0 | 9 | Inv. ex. |
| 10 | 575 | 1533 | 0.18 | 4448 | None | 40.0 | 25 | Inv. ex. |
| 11 | 575 | 1523 | 0.20 | 4504 | None | 40.0 | 68 | Inv. ex. |
| 12 | 575 | 1532 | 0.20 | 4454 | None | 40.0 | 35 | Inv. ex. |
| 13 | 575 | 1431 | 0.20 | 4024 | None | 40.0 | 65 | Inv. ex. |
| 14 | 570 | 1360 | 0.20 | 4080 | None | 40.0 | 16 | Inv. ex. |
| 15 | 575 | 1373 | 0.20 | 4111 | None | 40.0 | 75 | Inv. ex. |
| 16 | 575 | 1495 | 0.12 | 4329 | None | 40.0 | 12 | Inv. ex. |
| 17 | 575 | 1344 | 0.20 | 3713 | Yes | 35.0 | 125 | Comp. ex. |
| 18 | 570 | 1327 | 0.20 | 3667 | Yes | 29.0 | 155 | Comp. ex. |
| 19 | 600 | 1326 | 0.20 | — | — | — | — | Comp. ex. |
| 20 | 575 | 1577 | 0.25 | 3892 | Yes | 21.0 | 150 | Comp. ex. |
| 21 | 575 | 1799 | 0.20 | — | — | — | — | Comp. ex. |
| 22 | 575 | 1519 | 0.20 | — | — | — | — | Comp. ex. |
| 23 | 600 | 1349 | 0.20 | 3584 | Yes | 25.0 | 140 | Comp. ex. |
| 24 | 575 | 1341 | 0.20 | — | — | — | — | Comp. ex. |
| 25 | 575 | 1319 | 0.20 | 3774 | Yes | 28.0 | 140 | Comp. ex. |
| 26 | 575 | 1486 | 0.20 | 4318 | Yes | 37.0 | 105 | Comp. ex. |
| 27 | 575 | 1401 | 0.20 | 4210 | Yes | 32.0 | 111 | Comp. ex. |
| 28 | 575 | 1317 | 0.18 | 3915 | Yes | 8.0 | 210 | Comp. ex. |
| 29 | 570 | 1393 | 0.22 | 3580 | Yes | 28.0 | 125 | Comp. ex. |

Example 2

This is an example of the case using steel containing Mo. A billet using steel having each of the chemical components shown in Table 3 was used in the same way as in Example 1 to make a steel rod having a diameter of 5.5 mm, this steel rod was coiled in a ring shape at a predetermined temperature, then was patented by Stelmor treatment or patented by immersion in molten salt (DLP).

Samples were taken from the patented rolled rod in the same way as in Example 1 and subjected to a tensile test and observed by SEM.

Next, to obtain the drawing characteristics of the steel rod, the material was drawn in the same way as in Example 1 to obtain a steel wire having a final drawing diameter. Samples were extracted from the obtained steel wire and subjected to a tensile test and measured for number density of voids.

Further, the prepared steel wire was used and twisted in the same way as in Example 1 and examined for the occurrence of breakage of wire and the breakage stress.

The conditions for producing the rolled steel rod, the conditions for the final patenting, and the characteristics of the obtained steel rod and steel wire are shown in Table 4. In Table 4, Nos. a to h are examples using steels of the corresponding Nos. a to h of Table 3. Nos. a to d are invention example and Nos. e to h are comparative examples.

In the invention examples, steel wires were obtained having high tensile strength without any wire breakage. Further, these steel wires could be twisted into strands without the wires breaking from the twisting.

As opposed to this, in the comparative examples, the chemical components satisfied the conditions of the present invention and the materials could be drawn into steel wire, but the cooling rate after coiling was low, so the amounts of coarse pearlite and non-pearlite of the steel rod were both large, the number density of voids remaining after drawing was also high, and wire breakage occurred from twisting when twisting into strands.

TABLE 3

| No. | Element (mass %, mass ppm): C | Si | Mn | P | S | B (ppm) | Solute B (ppm) | Al | Ti | N (ppm) | O (ppm) | Mo | Cr | Ni | Cu | V | Co | Nb | Remarks |
|---|---|---|---|---|---|---|---|---|---|---|---|---|---|---|---|---|---|---|---|
| a | 1.07 | 0.22 | 0.3 | 0.008 | 0.008 | 12 | 7 | 0.001 | | 27 | 35 | 0.030 | 0.20 | | | | | | Inv. ex. |
| b | 1.12 | 0.20 | 0.32 | 0.008 | 0.008 | 8 | 5 | | | 25 | 34 | 0.090 | 0.20 | | | | | | Inv. ex. |
| c | 1.12 | 0.22 | 0.3 | 0.008 | 0.008 | 6 | 5 | 0.001 | | 24 | 25 | 0.030 | 0.20 | | | | | | Inv. ex. |
| d | 1.12 | 0.20 | 0.31 | 0.008 | 0.008 | 8 | 5 | | | 27 | 21 | 0.006 | 0.20 | | | | | | Inv. ex. |

TABLE 3-continued

| No. | C | Si | Mn | P | S | B (ppm) | Solute B (ppm) | Al | Ti | N (ppm) | O (ppm) | Mo | Cr | Ni | Cu | V | Co | Nb | Remarks |
|---|---|---|---|---|---|---|---|---|---|---|---|---|---|---|---|---|---|---|---|
| | Element (mass %, mass ppm) | | | | | | | | | | | | | | | | | | |
| e | 1.12 | 0.22 | 0.3 | 0.008 | 0.008 | 7 | 4 | 0.001 | | 27 | 35 | 0.006 | 0.20 | | | | | | Comp. ex. |
| f | 1.02 | 0.18 | 0.3 | 0.008 | 0.008 | 12 | 7 | | | 26 | 26 | 0.030 | 0.18 | | | | | | Comp. ex. |
| g | 1.02 | 0.20 | 0.5 | 0.008 | 0.010 | 12 | 8 | | | 27 | 22 | 0.110 | 0.20 | | | | | | Comp. ex. |
| h | 0.92 | 0.20 | 0.3 | 0.019 | 0.025 | 8 | 6 | | | 27 | 25 | 0.030 | 0.18 | | | | | | Comp. ex. |

Note:
Blanks indicate no addition.

TABLE 4

| | Steel rod production conditions | | | | Characteristics of rolled steel rod after patenting | | | | Final patenting conditions and characteristics | |
|---|---|---|---|---|---|---|---|---|---|---|
| No. | Diameter/ mm | Coil. temp./ ° C. | Cool. method | 800 to 700° C. cooling rate/ ° C./s | Rolled rod. strength/ MPa | Non-pearl. area per./% | Coarse pearl. area per./% | Non-pearl. and coarse pearl. total | Pat. wire diameter/ mm | Pat. method |
| a | 5.5 | 940 | DLP | 87.0 | 1586 | 0.9 | 2.3 | 3.2 | 1.26 | LP |
| b | 5.5 | 945 | Stelmor | 28.5 | 1518 | 1.3 | 4.8 | 6.1 | 1.26 | LP |
| c | 5.5 | 920 | DLP | 95.0 | 1575 | 0.8 | 2.8 | 3.6 | 1.18 | LP |
| d | 5.5 | 930 | DLP | 98.0 | 1580 | 0.7 | 1.6 | 2.3 | 1.18 | LP |
| e | 5.5 | 955 | Stelmor | 17.0 | 1320 | 3.9 | 13.0 | 16.9 | 1.26 | LP |
| f | 5.5 | 870 | Stelmor | 13.0 | 1240 | 3.5 | 15.0 | 18.5 | 1.46 | LP |
| g | 5.5 | 870 | Stelmor | 9.0 | 1210 | 4.2 | 23.0 | 27.2 | 1.46 | LP |
| h | 5.0 | 820 | Stelmor | 15.0 | 1140 | 5.2 | 19.0 | 24.2 | 1.46 | LP |

| | Final patenting conditions and characteristics | | Steel wire characteristics | | | | | |
|---|---|---|---|---|---|---|---|---|
| No. | Pat. temp./ ° C. | Patent. wire strength/ MPa | Final wire diameter/ mm | Final wire strength/ MPa | Wire break. in twisting | Twist break. stress (TS ratio %) | Void number density// $mm^2$ | Remarks |
| a | 575 | 1560 | 0.22 | 4520 | None | 40.0 | 25 | Inv. ex. |
| b | 575 | 1630 | 0.20 | 4550 | None | 40.0 | 21 | Inv. ex. |
| c | 575 | 1640 | 0.20 | 4510 | None | 40.0 | 18 | Inv. ex. |
| d | 575 | 1630 | 0.22 | 4605 | None | 40.0 | 12 | Inv. ex. |
| e | 575 | 1625 | 0.22 | 4520 | Yes | 31.0 | 130 | Comp. ex. |
| f | 575 | 1460 | 0.20 | 4280 | Yes | 23.0 | 144 | Comp. ex. |
| g | 575 | 1520 | 0.20 | 4469 | Yes | 19.0 | 185 | Comp. ex. |
| h | 575 | 1410 | 0.20 | 4077 | Yes | 25.0 | 125 | Comp. ex. |

Example 3

This is an example of the case of mainly using steel containing W and partially using steel containing both W and Mo. A billet using steel having each of the chemical components shown in Table 5 was used in the same way as in Example 1 to make a steel rod having a diameter of 4 to 6 mm, the steel rod was coiled in a ring shape at a predetermined temperature, then this was patented by a Stelmor treatment.

Samples were taken from the patented rolled steel rod in the same way as Example 1 and subjected to a tensile test and observed by SEM.

Next, to obtain the drawing characteristics of the steel rod, the rod was drawn in the same way as in Example 1 to obtain a steel wire having a final drawing diameter. Samples were extracted from the obtained steel wire and subjected to a tensile test and measured for number density of voids.

Further, the prepared steel wire was used and twisted in the same way as in Example 1 and examined for the occurrence of breakage of wire and the breakage stress.

The conditions for producing the rolled steel rod, the conditions for the final patenting, and the characteristics of the obtained steel rod and steel wire are shown in Table 6.

In Table 6, Nos. 1 to 16 are invention examples using steels of the corresponding Nos. 1 to 16 of Table 5. Similarly, 17 to 28 are comparative examples. The entries of "-" in the characteristics column of the steel wires of the comparative examples are cases where the wire broke at the final drawing pass or a prior pass. The final drawing diameter is the diameter at the time of that pass.

Figure 4:
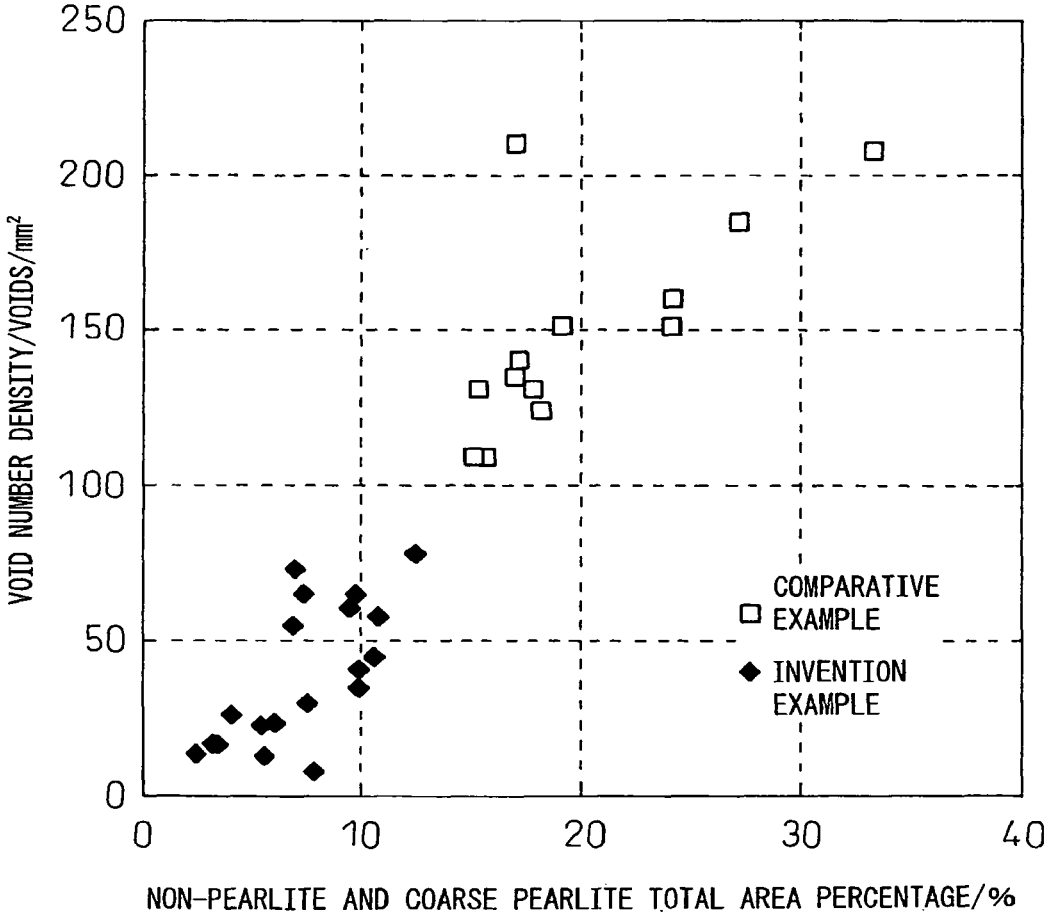
FIG. 4 is a view showing the relationship between the total value of the area percentages of the coarse pearlite and non-pearlite of rolled steel rod using steel containing W and a void percentage after drawing.
Figure 5:
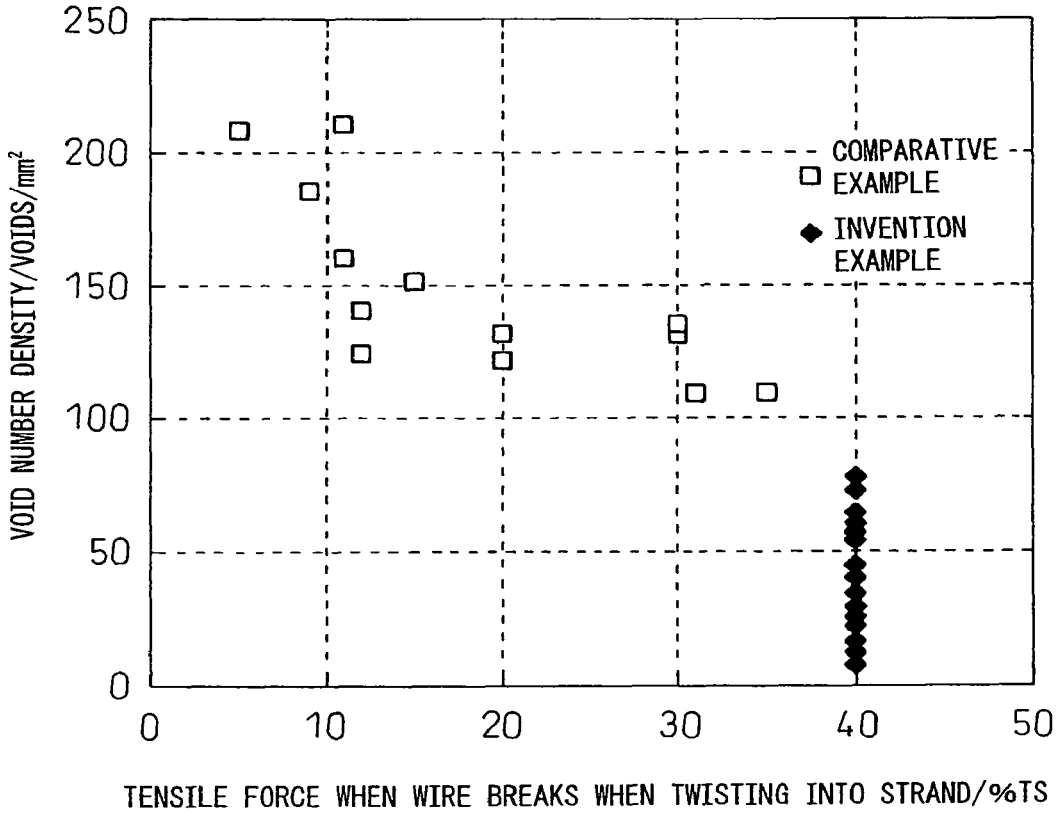
FIG. 5 is a view showing the relationship between the void number density of steel wire using steel containing W and breakage stress when a stranded steel wire breaks during twisting (40% means no breakage).
Figure 6:
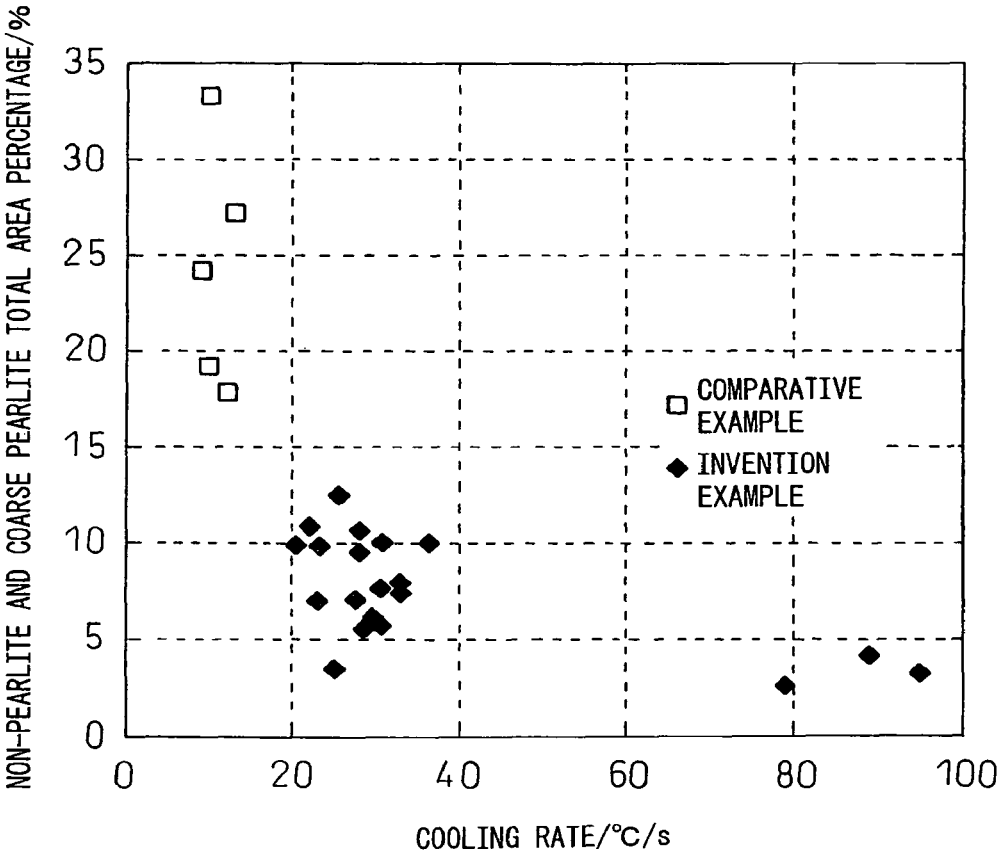
FIG. 6 is a view showing the relationship between the cooling rate between 800 to 700° C. after coiling of rolled steel rod using steel containing W and the total value of the area percentages of the coarse pearlite and non-pearlite after cooling.

Based on the values of Table 6, FIGS. 4 to 6 show similar relationships as FIGS. 1 to 3 of Example 1. FIGS. 4 to 6 show that even when using steel containing W, similar relationships to Example 1 using steel containing Mo are obtained.

As shown in Table 6, in the invention examples, steel wires were obtained having high tensile strength without any wire breakage. Further, the steel wires could be twisted into strands without the wires breaking from twisting.

As opposed to this, in the comparative examples, there were the following problems. The wires broke during drawing or broke during twisting after drawing.

17 is an example where the coiling temperature was low, so B nitrides and carbides precipitated before patenting, so the amount of solute B cannot be secured, therefore non-pearlite and coarse pearlite could not be suppressed.

18 is an example where the coiling temperature after rolling was too high, so BN precipitated in a large amount in the cooling process and, further, the austenite grains coarsened, so coarse grain boundary ferrite and the ductility deteriorated.

19, 22, 24, 26, and 29 are examples where the amount of B was low or not added, so non-pearlite and coarse pearlite could not be suppressed.

19, 26, and 30 are examples where W was not added or not enough, so the formation of coarse pearlite could not be suppressed.

20 is an example where the cooling rate was small, so the TS was low and there was a large amount of non-pearlite and coarse pearlite.

21 is an example where the amount of B was excessive, a large amount of B carbide and proeutectoid cementite ended up precipitating at the austenite grain boundaries, and the drawing characteristics were poor.

23 is an example where the amount of Si was excessive and non-pearlite (proeutectoid ferrite) precipitation could not be suppressed.

25 is an example where the amount of C was excessive and proeutectoid cementite precipitation could not be suppressed, so wire breakage occurred at primary drawing.

27 is an example where the amount of Mn was excessive and pearlite transformation did not finish during rolling, so primary drawability dropped and the wire broke.

28 is an example where the amount of W was excessive and pearlite transformation did not finish during rolling, so wire breakage occurred at primary drawing.

TABLE 5

| | Element (mass %, mass ppm) | | | | | | | | | |
|---|---|---|---|---|---|---|---|---|---|---|
| No. | C | Si | Mn | P | S | B (ppm) | Solute B (ppm) | Al | Ti | N (ppm) |
| 1 | 1.02 | 0.30 | 0.5 | 0.010 | 0.025 | 11 | 7 | | 0.001 | 20 |
| 2 | 0.82 | 0.20 | 0.5 | 0.008 | 0.008 | 9 | 6 | | | 25 |
| 3 | 1.02 | 0.20 | 0.3 | 0.008 | 0.009 | 8 | 5 | | | 20 |
| 4 | 1.12 | 0.18 | 0.5 | 0.010 | 0.010 | 15 | 11 | | | 26 |
| 5 | 1.02 | 0.20 | 0.35 | 0.019 | 0.007 | 9 | 6 | | 0.001 | 22 |
| 6 | 0.91 | 0.60 | 0.3 | 0.008 | 0.008 | 4 | 3 | 0.004 | | 25 |
| 7 | 0.92 | 0.20 | 0.3 | 0.009 | 0.008 | 24 | 11 | | | 25 |
| 8 | 0.90 | 0.20 | 0.3 | 0.008 | 0.008 | 12 | 8 | | | 27 |
| 9 | 1.05 | 0.20 | 0.35 | 0.010 | 0.020 | 11 | 6 | | 0.004 | 27 |
| 10 | 0.82 | 0.20 | 0.5 | 0.008 | 0.008 | 21 | 12 | 0.001 | | 25 |
| 11 | 1.02 | 0.20 | 0.45 | 0.025 | 0.008 | 12 | 8 | 0.001 | | 26 |
| 12 | 0.92 | 0.20 | 0.5 | 0.008 | 0.008 | 13 | 9 | | | 24 |
| 13 | 0.92 | 0.20 | 0.3 | 0.019 | 0.013 | 12 | 8 | | | 21 |
| 14 | 0.92 | 0.20 | 0.4 | 0.008 | 0.010 | 28 | 19 | | | 27 |
| 15 | 0.93 | 0.55 | 0.49 | 0.008 | 0.025 | 13 | 9 | | | 26 |
| 16 | 0.92 | 0.33 | 0.45 | 0.015 | 0.070 | 8 | 6 | 0.001 | | 27 |
| 17 | 0.83 | 0.35 | 0.5 | 0.007 | 0.010 | 11 | 6 | | | 34 |
| 18 | 0.82 | 1.00 | 0.5 | 0.025 | 0.020 | 20 | 13 | 0.030 | | 35 |
| 19 | 0.96 | 0.20 | 0.5 | 0.010 | 0.009 | 2 | | | 0.010 | 50 |
| 20 | 0.82 | 0.20 | 0.45 | 0.019 | 0.025 | 20 | 14 | | | 25 |
| 21 | 0.82 | 0.20 | 0.5 | 0.010 | 0.009 | 44 | 26 | | 0.005 | 25 |
| 22 | 0.92 | 0.20 | 0.5 | 0.010 | 0.009 | | | | 0.010 | 25 |
| 23 | 1.02 | 1.65 | 0.5 | 0.015 | 0.013 | 20 | 11 | | 0.010 | 25 |
| 24 | 0.87 | 0.20 | 0.4 | 0.010 | 0.009 | | | | 0.010 | 25 |
| 25 | 1.28 | 1.00 | 0.3 | 0.015 | 0.013 | 15 | 9 | 0.030 | | 25 |
| 26 | 0.90 | 0.20 | 0.8 | 0.010 | 0.009 | | | | 0.010 | 25 |
| 27 | 0.92 | 0.30 | 1.6 | 0.015 | 0.013 | 16 | 7 | 0.025 | | 25 |
| 28 | 0.82 | 0.20 | 0.5 | 0.010 | 0.009 | 12 | 7 | | 0.010 | 25 |
| 29 | 0.90 | 0.20 | 0.8 | 0.010 | 0.009 | 3 | | | 0.010 | 25 |
| 30 | 0.93 | 0.20 | 0.31 | 0.008 | 0.007 | 11 | 8 | 0.001 | | 26 |

| | Element (mass %, mass ppm) | | | | | | | | | |
|---|---|---|---|---|---|---|---|---|---|---|
| No. | O (ppm) | W | Mo | Cr | Ni | Cu | V | Co | Nb | Remarks |
| 1 | 13 | 0.005 | | | | | | | | Inv. ex. |
| 2 | 22 | 0.020 | | | 0.10 | | | 0.10 | | Inv. ex. |
| 3 | 28 | 0.040 | | | | 0.10 | | | | Inv. ex. |
| 4 | 22 | 0.030 | | 0.18 | | | | | | Inv. ex. |
| 5 | 31 | 0.020 | 0.04 | | | | | | | Inv. ex. |
| 6 | 23 | 0.050 | | | | | 0.03 | | 0.05 | Inv. ex. |
| 7 | 21 | 0.030 | | | | | 0.06 | | | Inv. ex. |
| 8 | 21 | 0.015 | | 0.23 | | | | | | Inv. ex. |
| 9 | 21 | 0.100 | | 0.18 | | | | | | Inv. ex. |
| 10 | 18 | 0.050 | | | | | | | | Inv. ex. |
| 11 | 23 | 0.006 | | 0.22 | | | | | | Inv. ex. |
| 12 | 21 | 0.022 | 0.05 | | | | | | | Inv. ex. |

TABLE 5-continued

| | | | | | | | | | |
|---|---|---|---|---|---|---|---|---|---|
| 13 | 23 | 0.080 | | | | | | | Inv. ex. |
| 14 | 22 | 0.006 | | | | | | | Inv. ex. |
| 15 | 16 | 0.150 | 0.20 | | 0.20 | | | 0.02 | Inv. ex. |
| 16 | 35 | 0.100 | | | | | | | Inv. ex. |
| 17 | 21 | 0.010 | 0.18 | | | | | | Comp. ex. |
| 18 | 20 | 0.018 | | | | | | | Comp. ex. |
| 19 | 24 | | | | | | | | Comp. ex. |
| 20 | 19 | 0.005 | | | | | | | Comp. ex. |
| 21 | 18 | 0.015 | | 0.10 | | | | | Comp. ex. |
| 22 | 20 | 0.020 | | | | | | | Comp. ex. |
| 23 | 22 | 0.012 | | | | | | | Comp. ex. |
| 24 | 22 | 0.010 | | | | | | | Comp. ex. |
| 25 | 17 | 0.020 | | | | | 0.30 | | Comp. ex. |
| 26 | 24 | 0.003 | | | | | | | Comp. ex. |
| 27 | 21 | 0.018 | | | | 0.20 | | | Comp. ex. |
| 28 | 23 | 0.220 | | | | 0.10 | | | Comp. ex. |
| 29 | 24 | 0.005 | | | | | | | Comp. ex. |
| 30 | 23 | | 0.22 | | | | | | Comp. ex. |

Note:

Blanks indicate no addition.

TABLE 6

| | Steel rod production conditions | | | | Characteristics of rolled steel rod after patenting | | | | Final patenting conditions and characteristics | |
|---|---|---|---|---|---|---|---|---|---|---|
| No. | Diameter/ mm | Coil. temp./ ° C. | Cool. method | 800 to 700° C. cooling rate/ ° C./s | Rolled rod. strength/ MPa | Non-pearl. area per./% | Coarse pearl. area per./% | Non-pearl. and coarse pearl. total | Pat. wire diameter/ mm | Pat. method |
| 1 | 5.5 | 860 | Stelmor | 25.5 | 1385 | 2.7 | 9.8 | 12.5 | 1.46 | LP |
| 2 | 5.5 | 820 | Stelmor | 20.5 | 1141 | 1.8 | 8.1 | 9.9 | 1.50 | LP |
| 3 | 5.5 | 860 | Stelmor | 30.5 | 1423 | 1.4 | 6.3 | 7.7 | 1.60 | LP |
| 4 | 5.5 | 870 | Stelmor | 33.0 | 1550 | 2.1 | 5.9 | 8 | 1.45 | FBP |
| 5 | 5.5 | 880 | Stelmor | 23.3 | 1362 | 2.4 | 7.5 | 9.9 | 1.40 | LP |
| 6 | 5.5 | 820 | Stelmor | 23.0 | 1248 | 2.8 | 4.2 | 7 | 1.40 | LP |
| 7 | 5.5 | 870 | Stelmor | 28.0 | 1302 | 1.9 | 7.7 | 9.6 | 1.40 | LP |
| 8 | 5.5 | 860 | Stelmor | 22.3 | 1232 | 1.3 | 9.6 | 10.9 | 1.45 | LP |
| 9 | 5 | 820 | Stelmor | 33.0 | 1476 | 2.1 | 5.4 | 7.5 | 1.50 | LP |
| 10 | 5.5 | 870 | Stelmor | 29.5 | 1220 | 2.4 | 3.8 | 6.2 | 1.30 | LP |
| 11 | 4 | 855 | Stelmor | 28.0 | 1405 | 1.9 | 8.8 | 10.7 | 1.30 | LP |
| 12 | 6 | 895 | Stelmor | 30.8 | 1331 | 2.7 | 7.3 | 10 | 1.40 | LP |
| 13 | 5.5 | 870 | Stelmor | 27.5 | 1297 | 2.3 | 4.8 | 7.1 | 1.60 | FBP |
| 14 | 5.5 | 870 | Stelmor | 36.3 | 1376 | 1.9 | 8.1 | 10 | 1.45 | LP |
| 15 | 5.5 | 870 | Stelmor | 25.0 | 1290 | 1.2 | 2.3 | 3.5 | 1.60 | FBP |
| 16 | 5.5 | 860 | Stelmor | 30.5 | 1327 | 2.6 | 3.2 | 5.8 | 0.84 | LP |
| 17 | 5.5 | 750 | Stelmor | 33.0 | 1260 | 5.8 | 9.6 | 15.4 | 1.40 | LP |
| 18 | 5.5 | 965 | Stelmor | 27.3 | 1200 | 5.6 | 10.2 | 15.8 | 1.30 | LP |
| 19 | 5.5 | 870 | Stelmor | 28.0 | 1347 | 4.4 | 19.8 | 24.2 | 1.40 | LP |
| 20 | 5.5 | 870 | Stelmor | 10.0 | 1049 | 4.1 | 29.2 | 33.3 | 1.46 | LP |
| 21 | 5.5 | 860 | Stelmor | 26.0 | 1189 | 1.8 | 8.2 | 10 | 1.50 | LP |
| 22 | 5.5 | 890 | Stelmor | 38.3 | 1396 | 5.2 | 10.3 | 15.5 | 1.60 | LP |
| 23 | 5.5 | 900 | Stelmor | 30.0 | 1424 | 8.5 | 8.5 | 17 | 1.40 | LP |
| 24 | 5.5 | 880 | Stelmor | 40.5 | 1363 | 5.1 | 10.1 | 15.2 | 1.45 | LP |
| 25 | 5.5 | 820 | Stelmor | 33.0 | 1705 | 2.5 | 7.3 | 9.8 | 1.20 | LP |
| 26 | 5.5 | 870 | Stelmor | 24.5 | 1264 | 4.6 | 12.5 | 17.1 | 1.50 | LP |
| 27 | 5.5 | 820 | Stelmor | 28.5 | 1338 | 10.2 | 9.1 | 19.3 | 1.40 | LP |
| 28 | 5.5 | 870 | Stelmor | 24.0 | 1172 | 13.2 | 2.8 | 16 | 1.50 | FBP |
| 29 | 5.5 | 870 | Stelmor | 24.5 | 1264 | 3.6 | 13.6 | 17.2 | 1.50 | LP |
| 30 | 5.5 | 855 | Stelmor | 28.0 | 1312 | 2.4 | 15.8 | 18.2 | 1.30 | LP |

TABLE 6-continued

| No. | Final patenting conditions and characteristics: Pat. temp./° C. | Patent. wire strength/MPa | Steel wire characteristics: Final wire diameter/mm | Final wire strength/MPa | Wire break. in twisting | Twist break. stress (TS ratio %) | Void number density//mm$^2$ | Remarks |
|---|---|---|---|---|---|---|---|---|
| 1 | 575 | 1548 | 0.20 | 4515 | None | 40.0 | 78 | Inv. ex. |
| 2 | 575 | 1323 | 0.20 | 3787 | None | 40.0 | 64 | Inv. ex. |
| 3 | 575 | 1510 | 0.22 | 4395 | None | 40.0 | 30 | Inv. ex. |
| 4 | 575 | 1591 | 0.20 | 4690 | None | 40.0 | 8 | Inv. ex. |
| 5 | 550 | 1496 | 0.22 | 4062 | None | 40.0 | 65 | Inv. ex. |
| 6 | 575 | 1458 | 0.20 | 4093 | None | 40.0 | 55 | Inv. ex. |
| 7 | 575 | 1419 | 0.20 | 3990 | None | 40.0 | 61 | Inv. ex. |
| 8 | 575 | 1409 | 0.20 | 4020 | None | 40.0 | 58 | Inv. ex. |
| 9 | 600 | 1555 | 0.20 | 4619 | None | 40.0 | 65 | Inv. ex. |
| 10 | 575 | 1333 | 0.18 | 3743 | None | 40.0 | 24 | Inv. ex. |
| 11 | 570 | 1527 | 0.22 | 3891 | None | 40.0 | 45 | Inv. ex. |
| 12 | 550 | 1414 | 0.20 | 3974 | None | 40.0 | 41 | Inv. ex. |
| 13 | 575 | 1370 | 0.20 | 4117 | None | 40.0 | 73 | Inv. ex. |
| 14 | 575 | 1421 | 0.20 | 4066 | None | 40.0 | 35 | Inv. ex. |
| 15 | 570 | 1403 | 0.20 | 4221 | None | 40.0 | 17 | Inv. ex. |
| 16 | 575 | 1313 | 0.12 | 3691 | None | 40.0 | 13 | Inv. ex. |
| 17 | 575 | 1359 | 0.20 | 3762 | Yes | 30 | 131 | Comp. ex. |
| 18 | 600 | 1349 | 0.20 | 3584 | Yes | 20 | 121 | Comp. ex. |
| 19 | 570 | 1437 | 0.20 | 4065 | Yes | 15 | 151 | Comp. ex. |
| 20 | 575 | 1317 | 0.18 | 3915 | Yes | 5 | 208 | Comp. ex. |
| 21 | 600 | 1231 | 0.20 | — | — | — | — | Comp. ex. |
| 22 | 575 | 1401 | 0.20 | 4210 | Yes | 35 | 109 | Comp. ex. |
| 23 | 575 | 1699 | 0.25 | 4294 | Yes | 11 | 155 | Comp. ex. |
| 24 | 575 | 1357 | 0.20 | 3850 | Yes | 31 | 109 | Comp. ex. |
| 25 | 575 | 1784 | 0.20 | — | — | — | — | Comp. ex. |
| 26 | 575 | 1415 | 0.20 | 4104 | Yes | 30 | 135 | Comp. ex. |
| 27 | 575 | 1527 | 0.20 | — | — | — | — | Comp. ex. |
| 28 | 575 | 1231 | — | — | — | — | — | Comp. ex. |
| 29 | 575 | 1415 | 0.20 | 4104 | Yes | 12 | 140 | Comp. ex. |
| 30 | 570 | 1393 | 0.22 | 3580 | Yes | 12 | 124 | Comp. ex. |

Example 4

This is an example of the case using steel containing W. A billet using steel having each of the chemical components shown in Table 7 was used in the same way as in Example 1 to make a steel rod having a diameter of 4 mm to 5.5 mm, the steel rod was coiled in a ring shape at a predetermined temperature, then was patented by Stelmor treatment or patented by immersion in molten salt (DLP).

Samples were taken from the patented rolled steel rod in the same way as Example 1 and subjected to a tensile test and observed by SEM.

Next, to obtain the drawing characteristics of the steel rod, the material was drawn in the same way as in Example 1 to obtain a steel wire having a final drawing diameter. Samples were extracted from the obtained steel wire and subjected to a tensile test and measured for number density of voids.

Further, the obtained steel wire was used and twisted in the same way as in Example 1 and examined for the occurrence of breakage of wire and the breakage stress.

The conditions for producing the rolled steel rod, the conditions for the final patenting, and the characteristics of the obtained steel rod and steel wire are shown in Table 8.

In Table 8, Nos. a to h are examples using steels of the corresponding Nos. a to h of Table 7, Nos. a to d are invention examples, and Nos. e to h are comparative examples.

In the invention examples, steel wires were obtained having high tensile strength without any wire breakage. Further, the steel wires could be formed into strands without the wires breaking from twisting.

As opposed to this, in the comparative examples, the chemical components satisfied the conditions of the present invention and the materials could be drawn into steel wire, but the cooling rate after coiling was low, so the amounts of coarse pearlite and non-pearlite of the steel rod were both large, the density of voids remaining after drawing was also high, and wire breakage occurred from twisting when twisting into strands.

TABLE 7

| No. | Element (mass %, mass ppm): C | Si | Mn | P | S | B (ppm) | Solute B (ppm) | Al | Ti | N (ppm) | O (ppm) | W | Mo | Cr | Ni | Cu | V | Co | Nb | Remarks |
|---|---|---|---|---|---|---|---|---|---|---|---|---|---|---|---|---|---|---|---|---|
| a | 1.02 | 0.20 | 0.5 | 0.008 | 0.008 | 9 | 6 | 0.001 | 0.000 | 24 | 25 | 0.030 | | | | | | | | Inv. ex. |
| b | 1.10 | 0.22 | 0.3 | 0.008 | 0.008 | 7 | 4 | 0.001 | 0.000 | 27 | 35 | 0.006 | | 0.20 | | | | | | Inv. ex. |
| c | 1.12 | 0.20 | 0.32 | 0.008 | 0.008 | 8 | 5 | 0.000 | 0.000 | 25 | 34 | 0.030 | | 0.20 | | | | | | Inv. ex. |

TABLE 7-continued

| | Element (mass %, mass ppm) | | | | | | | | | | | | | | | | | | | |
|---|---|---|---|---|---|---|---|---|---|---|---|---|---|---|---|---|---|---|---|---|
| No. | C | Si | Mn | P | S | B (ppm) | Solute B (ppm) | Al | Ti | N (ppm) | O (ppm) | W | Mo | Cr | Ni | Cu | V | Co | Nb | Remarks |
| d | 1.12 | 0.21 | 0.3 | 0.006 | 0.007 | 9 | 4 | 0.001 | 0.000 | 28 | 25 | 0.007 | | 0.22 | | | | | | Inv. ex. |
| e | 0.90 | 0.20 | 0.3 | 0.008 | 0.008 | 12 | 8 | 0.000 | 0.000 | 27 | 21 | 0.005 | | 0.23 | | | | | | Comp. ex. |
| f | 1.12 | 0.20 | 0.32 | 0.008 | 0.008 | 8 | 5 | 0.000 | 0.000 | 25 | 34 | 0.030 | | 0.20 | | | | | | Comp. ex. |
| g | 1.02 | 0.20 | 0.45 | 0.025 | 0.008 | 12 | 7 | 0.001 | 0.000 | 26 | 23 | 0.006 | | 0.22 | | | | | | Comp. ex. |
| h | 0.92 | 0.20 | 0.4 | 0.008 | 0.010 | 28 | 19 | 0.000 | 0.000 | 27 | 22 | 0.006 | | | | | | | | Comp. ex. |

Note:
Blanks indicate no addition.

TABLE 8

| | Steel rod production conditions | | | | Characteristics of rolled steel rod after patenting | | | | Final patenting conditions and characteristics | |
|---|---|---|---|---|---|---|---|---|---|---|
| No. | Diameter/ mm | Coil. temp./ ° C. | Cool. method | 800 to 700° C. cooling rate/ ° C./s | Rolled rod. strength/ MPa | Non-pearl. area per./% | Coarse pearl. area per./% | Non-pearl. and coarse pearl. total | Pat. wire diameter/ mm | Pat. method |
| a | 5.5 | 920 | DLP | 95.0 | 1560 | 0.8 | 2.5 | 3.3 | 1.18 | LP |
| b | 5.5 | 895 | DLP | 89.0 | 1575 | 0.9 | 3.3 | 4.2 | 1.26 | LP |
| c | 5.5 | 930 | Stelmor | 28.5 | 1530 | 1.3 | 4.3 | 5.6 | 1.26 | LP |
| d | 5.5 | 920 | DLP | 79.0 | 1625 | 0.7 | 1.9 | 2.6 | 1.18 | LP |
| e | 5.5 | 860 | Stelmor | 12.0 | 1132 | 3.6 | 14.2 | 17.8 | 1.45 | LP |
| f | 5.5 | 930 | Stelmor | 10.0 | 1470 | 3.2 | 16.0 | 19.2 | 1.26 | LP |
| g | 4.0 | 855 | Stelmor | 13.0 | 1340 | 5.2 | 22.0 | 27.2 | 1.30 | LP |
| h | 5.5 | 870 | Stelmor | 9.0 | 1315 | 4.2 | 20.0 | 24.2 | 1.45 | LP |

| | Final patenting conditions and characteristics | | Steel wire characteristics | | | | | |
|---|---|---|---|---|---|---|---|---|
| No. | Pat. temp./ ° C. | Patent. wire. strength/ MPa | Final wire diameter/ mm | Final wire strength/ MPa | Wire break. in twisting | Twist break. stress (TS ratio %) | Void number density// $mm^2$ | Remarks |
| a | 575 | 1530 | 0.20 | 4522 | None | 40.0 | 17 | Inv. ex. |
| b | 575 | 1590 | 0.22 | 4535 | None | 40.0 | 26 | Inv. ex. |
| c | 575 | 1615 | 0.20 | 4555 | None | 40.0 | 23 | Inv. ex. |
| d | 575 | 1630 | 0.22 | 4620 | None | 40.0 | 14 | Inv. ex. |
| e | 575 | 1409 | 0.20 | 4020 | Yes | 20.0 | 131 | Comp. ex. |
| f | 575 | 1615 | 0.20 | 4555 | Yes | 15.0 | 151 | Comp. ex. |
| g | 570 | 1527 | 0.22 | 3891 | Yes | 9.0 | 185 | Comp. ex. |
| h | 575 | 1421 | 0.20 | 4066 | Yes | 11.0 | 160 | Comp. ex. |

INDUSTRIAL APPLICABILITY

By applying the present invention, it is possible to inexpensively obtain high strength steel wire superior in ductility, particularly twistability, used in steel cords, sawing wires, and the like, with high productivity and good yield from a high strength steel rod superior in ductility and has high industrial applicability.

The invention claimed is:

1. A method of producing a steel rod for steel wire superior in ductility, comprising:

hot rolling a steel billet into a steel rod having a diameter of 3 to 7 mm, coiling the steel rod at a temperature in the region of 800 to 950° C., then patenting the steel rod at a cooling rate of 20° C./s or more from 800° C. to 700° C., wherein the steel billet comprises, by mass % or mass ppm, C: 0.80 to 1.20%, Si: 0.1 to 1.5%, Mn: 0.1 to 1.0%, Al: 0.01% or less, Ti: 0.01% or less, one or both of W: 0.005 to 0.2% and Mo: 0.003 to 0.2%, N: 10 to 30 ppm, B: 4 to 30 ppm, wherein solute B is present in an amount of at least 3 ppm, O: 10 to 40 ppm, and a balance of Fe and unavoidable impurities, and wherein the steel rod has an area percentage of pearlite structures of 97% or more, a balance of non-pearlite structures comprising bainite, degenerated pearlite, and proeutectoid ferrite, and a total of the area percentage of non-pearlite structures and coarse pearlite structures of no more than 15%, wherein an apparent lamellar spacing is 600 nm or more.

2. The method of producing steel rod as set forth in claim 1, wherein the steel billet further comprises, by mass %, at least one of Cr: 0.5% or less, Ni: 0.5% or less, Co: 0.5% or less, V: 0.5% or less, Cu: 0.2% or less, or Nb: 0.1% or less.

3. A method of producing a steel wire superior in ductility comprising:

hot rolling a steel billet into a steel rod having a diameter of 3 to 7 mm, coiling the steel rod at a temperature in the region of 800 to 950° C., then patenting the steel rod at a cooling rate of 20° C./s or more from 800° C. to 700° C., drawing the steel rod, then intermediate patenting the drawn steel rod, and then further cold drawing the patented drawn steel rod, wherein the steel billet comprises, by mass % or mass ppm, C: 0.80 to 1.20%, Si: 0.1 to 1.5%, Mn: 0.1 to 1.0%, Al: 0.01% or less, Ti: 0.01% or less, one or both of W: 0.005 to 0.2% and Mo: 0.003 to 0.2%, N: 10 to 30 ppm, B: 4 to 30 ppm, wherein solute B is present in an amount of at least 3 ppm, O: 10 to 40 ppm, and a balance of Fe and unavoidable impurities, and wherein the steel rod has an area percentage of pearlite structures of 97% or more, a balance of non-pearlite structures comprising bainite, degenerated pearlite, and proeutectoid ferrite, and a total of the area percentage of non-pearlite structures and coarse pearlite structures of no more than 15%, wherein an apparent lamellar spacing is 600 nm or more.

4. The method of producing a steel wire as set forth in claim 3, wherein the steel billet further comprises, by mass %, at least one of Cr: 0.5% or less, Ni: 0.5% or less, Co: 0.5% or less, V: 0.5% or less, Cu: 0.2% or less, or Nb: 0.1% or less.

* * * * *